United States Patent [19]

Mifune et al.

[11] Patent Number: 4,665,017

[45] Date of Patent: May 12, 1987

[54] PROCESS FOR PREPARING SILVER HALIDE EMULSION AND SILVER HALIDE PHOTOGRAPHIC LIGHT-SENSITIVE MATERIAL

[75] Inventors: Hiroyuki Mifune; Tadao Shishido; Yoshiaki Suzuki, all of Kanagawa, Japan

[73] Assignee: Fuji Photo Film Co., Ltd., Kanagawa, Japan

[21] Appl. No.: 679,651

[22] Filed: Dec. 7, 1984

[30] Foreign Application Priority Data

Dec. 8, 1983 [JP] Japan ..... 58-232069
Jun. 15, 1984 [JP] Japan ..... 59-122982

[51] Int. Cl.[4] ..... G03C 1/08; G03C 1/36; G03C 1/02

[52] U.S. Cl. ..... 430/569; 430/567; 430/603; 430/606; 430/608; 430/943

[58] Field of Search ..... 430/603, 567, 569, 606, 430/608

[56] References Cited

U.S. PATENT DOCUMENTS

| | | | |
|---|---|---|---|
| 1,574,944 | 3/1926 | Sheppard | 430/603 |
| 3,021,215 | 2/1962 | Williams et al. | 430/603 |
| 3,057,724 | 10/1962 | Lovett et al. | 430/603 |
| 3,241,971 | 3/1966 | Kitze | 430/567 |
| 3,320,069 | 5/1967 | Illingsworth | 430/605 |
| 3,672,900 | 6/1972 | Kurz | 430/569 |
| 3,697,281 | 10/1972 | Milton | 430/603 |
| 4,416,980 | 11/1983 | Fujiwhara et al. | 430/567 |

*Primary Examiner*—Richard L. Schilling
*Attorney, Agent, or Firm*—Sughrue, Mion, Zinn, Macpeak & Seas

[57] ABSTRACT

A process for preparing a silver halide emulsion wherein a sulfur-containing silver halide solvent which accelerates growth of silver halide grains and an oxidizing agent capable of reducing or eliminating the grain growth effect of the sulfur-containing silver halide solvent are used, and a silver halide photographic light-sensitive material containing the silver halide emulsion prepared by the process are disclosed. The grain growth effect of the sulfur-containing silver halide solvent can be controlled at any necessary stage without accompanying substantial deterioration in photographic properties.

40 Claims, No Drawings

PROCESS FOR PREPARING SILVER HALIDE EMULSION AND SILVER HALIDE PHOTOGRAPHIC LIGHT-SENSITIVE MATERIAL

FIELD OF THE INVENTION

This invention relates to a novel process for preparing a silver halide emulsion and a silver halide photographic light-sensitive material containing the silver halide emulsion prepared by the novel process.

BACKGROUND OF THE INVENTION

It is well known that photographic sensitivity is increased by increasing the grain size of silver halide grains. In order to increase the grain size of silver halide crystals, a method using a silver halide solvent which accelerates the growth of silver halide crystals during precipitation or physical ripening of the silver halide is generally employed.

The silver halide solvents which can be used include nitrogen-containing silver halide solvents, the nitrogen atom of which accelerates the growth of grains by coordination to silver ions, such as ammonia; sulfur-containing silver halide solvents, the sulfur atom of which accelerates the growth of grains by coordination to silver ions, such as thioether compounds, thione compounds (hereinafter described in detail), thiocyanates; and the like.

Of these silver halide solvents, the nitrogen-containing compounds such as ammonia lose the coordination to silver ions upon neutralization with acids, thereby inactivating their effect to increase the growth of grains of silver halide crystals. In other words, ammonia is a convenient silver halide solvent since it functions to accelerate the growth of grains only in required stages and can be inactivated by neutralizing with acids when it is unnecessary to accelerate grain growth.

Therefore, after ammonia is used in the formation of silver halide crystals, neutralization with an acid can prevent crystals thus formed from changing due to unnecessary physical ripening until subsequent chemical ripening with chemical sensitizers and also can eliminate any adverse influence of ammonia on chemical ripening. Further, the neutralized ammonia does not interfere with the adsorption of various compounds added before coating (e.g., sensitizing dyes, antifoggants, stabilizers, etc.) onto silver halide crystals.

Moreover, because ammonia can lose its effect to cause grain growth in the course of the formation of silver halide crystals, it is possible to clearly distinguish between the central portion (core) and the periphery (outer shell) of the silver halide grains in terms of halogen composition. For example, in the case when it is intended to prepare a silver iodobromide photographic emulsion having high sensitivity and good graininess, i.e., when it is intended to form crystal grains comprising a silver iodobromide core having a high iodine content for the purpose of raising light absorption to increase sensitivity or improving graininess and a silver halide outer shell having a low iodine content for the purpose of accelerating development (double layered structure grains), it is required to make the silver halide solvent display its effect only in the formation of the core and to inactivate the silver halide solvent in the formation of the outer shell. This is because if a grain growth effect more than is necessary is encountered in the formation of the outer shell, the iodine in the core penetrates into the outer shell to increase the iodine content of the outer shell, thus resulting in adverse effects such as retardation of development and a reduction in contrast.

However, the method of using ammonia as a silver halide solvent has a strict limitation on the pH levels at which the method is applicable and the problem that the method is apt to increase fog.

As described above, it is only the nitrogen-containing silver halide solvents, e.g., ammonia, that can be inactivated when necessary. It has hitherto been impossible to inactivate the grain growing effect of sulfur-containing silver halide solvents, such as thioether compounds, thione compounds, thiocyanates, etc., by any means but removal by washing with water. However, washing with water to cease the effect of grain growth requires a great deal of cost and time in the production of silver halide emulsions and, therefore, is not suitable as a practical method. In addition, these sulfur-containing silver halide solvents cannot be completely removed by washing with water and remain in emulsions because of their higher affinity to silver halide grains as compared with ammonia. The sulfur-containing silver halide solvents remaining unremoved result in various unfavorable influences, such as on chemical ripening (e.g., fog is increased; chemical ripening proceeds drastically; chemical ripening cannot be easily stopped even by cooling or addition of hydroxytetraazaindene or sensitizing dyes; etc.), an accelerated deterioration in photographic properties during preservation, hindering adsorption of sensitizing dyes in the case of using silver halide solvents of strong adsorption, and the like.

Nevertheless, the sulfur-containing silver halide solvents have many advantages such that a dispersion of silver halide grains having a narrow grain size distribution can be produced more easily as compared with the use of ammonia; iodine distribution in a highly sensitive silver iodobromide emulsion can easily be made uniform; growth of grains can be accelerated at low pH levels; silver halide grains hardly sensitive to pressure can be formed; and the like.

In the light of the above-described circumstances, it has been strongly demanded to develop a system by which the grain growth effect of the sulfur-containing silver halide solvents can be reduced or inactivated whenever necessary like a system employing acids to inactivate ammonia.

SUMMARY OF THE INVENTION

Accordingly, an object of this invention is to provide a process for preparing a silver halide emulsion which overcomes the above-described problems encountered in the use of sulfur-containing silver halide solvents.

Another object of this invention is to provide a process for preparing a silver halide emulsion by which the influence of sulfur-containing silver halide solvents used in the formation or growth of silver halide grains on chemical ripening can be suppressed, thereby making it possible to perform proper chemical ripening, and to provide a silver halide photographic light-sensitive material containing an emulsion prepared by such a process.

Still another object of this invention is to provide a process for preparing a silver halide emulsion in which the grain growth effect of a sulfur-containing silver halide solvent used in the formation or growing of the silver halide grains is controlled, and to provide a silver halide photographic light-sensitive material containing an emulsion thus obtained.

As a result of extensive investigations, the present inventors found that the grain growth effect of sulfur-containing silver halide solvents can be reduced or inactivated at any optional stage without any serious deterioration of photographic properties by adding the hereinafter described oxidizing agent(s) thereto.

That is, the above-described objects of the present invention can be accomplished by a process for preparing a silver halide emulsion in which a sulfur-containing silver halide solvent that accelerates the growth of silver halide grains and an oxidizing agent capable of reducing or eliminating the grain growth effect of said sulfur-containing silver halide solvent are used, and a silver halide photographic light-sensitive material comprising a support having provided thereon at least one layer containing a silver halide emulsion prepared by the aforesaid process.

DETAILED DESCRIPTION OF THE INVENTION

The term "sulfur-containing silver halide solvents" used throughout the specification and claims refers to silver halide solvents containing sulfur atoms capable of coordinating to silver ions.

More specifically, the term "silver halide solvent" as used herein means that water or a mixed solvent of water-organic solvent (e.g., water/methanol=1/1 by weight) containing 0.02M silver halide solvent at 60° C. can dissolve silver halide in an amount twice or more the weight of silver halide which can be dissolved in water or the mixed solvent thereof at 60° C. in the absence of the silver halide solvent.

Specific examples of the sulfur-containing silver halide solvents which can be used in the present invention include thiocyanates (e.g., potassium rhodanide, ammonium rhodanide, etc.), organic thioether compounds (e.g., the compounds described in U.S. Pat. Nos. 3,574,628, 3,021,215, 3,057,724, 3,038,805, 4,276,374, 4,297,439 and 3,704,130, Japanese Patent Application (OPI) (Open to Public Inspection) No. 104926/82, etc.), thione compounds (e.g., the tetra-substituted thioureas described in Japanese Patent Application (OPI) Nos. 82408/78 and 77737/80, etc., particularly the compounds disclosed in Japanese Patent Application (OPI) No. 144319/78), mercapto compounds (e.g., those described in Japanese Patent Application (OPI) No. 202531/82) and meso-ionic compounds.

More specifically, the organic thioether compounds which are preferably used in the present invention are compounds represented by formula (I):

$$R^1\text{-}(S\text{-}R^3)_m S\text{-}R^2 \qquad (I)$$

wherein m represents 0 or an integer of from 1 to 4; $R^1$ and $R^2$, which may be the same or different, each represents a lower alkyl group having from 1 to 5 carbon atoms or a substituted alkyl group having from 1 to 30 total carbon atoms, which is substituted by —OH, —COOM, $—SO_3M$, $—NHR^4$, $—NR^4R^4$ (wherein the two $R^4$ may be the same or different), $—OR^4$, $—CONHR^4$, $—COOR^4$, a 5- or 6-membered heterocyclic group such as pyridyl, furyl or morpholinyl, etc.; M represents a hydrogen atom or a cation; $R^4$ represents a hydrogen atom, an alkyl group having 1 to 5 carbon atoms or a substituted alkyl group having 1 to 5 carbon atoms in the alkyl moiety substituted by not more than 12, preferably not more than 4, of the abovedescribed substituents which may be the same or different; or $R^1$ and $R^2$ form a cyclic thioether having not more than 30 carbon atoms when connected to each other; and $R^3$, which may be the same or different when m is 2 or more, represents an alkylene group having 1 to 12 carbon atoms or an alkylene group substituted with the substituent as described for $R^1$ and $R^2$, preferably one containing from 1 to 12 carbon atoms in its alkylene moiety, the alkylene chain of which may contain one or more of divalent groups such as —O—, —CONH—, $—SO_2NH—$, —COO—, $—NR^4—$ wherein $R^4$ is as defined above.

The thione compounds which are preferably used in the present invention are compounds represented by formula (II):

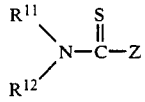

(II)

wherein Z represents

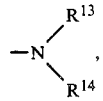

$—OR^{15}$ or $—SR^{16}$; $R^{11}$, $R^{12}$, $R^{13}$, $R^{14}$, $R^{15}$ and $R^{16}$, which may be the same or different, each represents an alkyl group, a substituted alkyl group, an alkenyl group, a substituted alkenyl group, an aralkyl group, a substituted aralkyl group (wherein each of the substituents is —OH, —COOM, $—SO_3M$, $—NHR^4$, $—NR^4R^4$, $—OR^4$, $—CONHR^4$, $—COOR^4$, a 5- or 6-membered heterocyclic group such as pyridyl, furyl or morpholinyl, $—NHCOR^4$, $—NHSO_2R^4$, $—NHCONHR^4$ wherein M and $R^4$ are as defined above), an aryl group, a substituted aryl group, a substituted or unsubstituted 5- or 6-membered nitrogen-containing heterocyclic group such as pyridyl, furyl or morpholinyl group, preferably one containing not more than 30 total carbon atoms (wherein the substituent is an alkyl group having 1 to 5 carbon atoms, a halogen atom such as chlorine or bromine, $—OR^4$, —OH, —COOM, $—SO_3M$, $—NHR^4$, $—NR^4R^4$, $—CONHR^4$, $—COOR^4$, $—SO_2NHR^4$, $—NHCOR^4$, $—NHSO_2R^4$ or $—NHCONHR^4$ wherein M and $R^4$ are as defined above); or $R^{11}$ and $R^{12}$, $R^{13}$ and $R^{14}$, or $R^{11}$ and $R^{13}$, $R^{11}$ and $R^{15}$, and $R^{11}$ and $R^{16}$ may form a 5- or 6-membered substituted or unsubstituted heterocyclic ring when connected to each other, respectively, for example, piperidine, piperazine, pyrrolidine, morpholine, imidazolidine, imidazoline, thiazolidine, thiazoline, 1,3,4-thiadiazoline, 1,3,5-oxadiazine, hexahydro-s-triazine, oxazolidine or oxazoline wherein the substituent is an alkyl group having 1 to 12 carbon atoms (which may be substituted with —OH, —COOM, $—SO_3M$, $—NHR^4$, $—NR^4R^4$, $—OR^4$, $—CONHR^4$, $—COOR^4$, a 5- or 6-membered heterocyclic group, $—NHCOR^4$, $—NHSO_2R^4$ or $—NHCONHR^4$ wherein M and $R^4$ are as defined above), or an aryl group such as a phenyl group (which may be substituted with an alkyl group having 1 to 5 carbon atoms, a halogen atom such as chlorine or bromine, $—OR^4$, —OH, —COOM, $—SO_3M$, $—NR^4R^4$, $—CONHR^4$, $—COOR^4$, $—SO_2NHR^4$, $—NHSO_2R^4$ or —NHCONHR$^4$ wherein M and R$^4$ are as defined above.

The mercapto compounds which are preferably used in the present invention are compounds represented by formula (III):

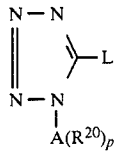

(III)

wherein A represents an alkylene group; R$^{20}$ represents —NH$_2$, —NHR$^{21}$,

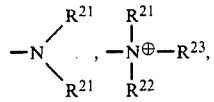

—CONHR$^{24}$, —OR$^{24}$, —COOM, —COOR$^{21}$, —SO$_2$NHR$^{24}$, —NHCOR$^{21}$ or —SO$_3$M (preferably one containing not more than 30 total carbon atoms); p represents 1 or 2; L represents —S$^{\ominus}$ when R$^{20}$ is

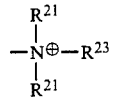

or L represents —SM when R$^{20}$ is a group other than

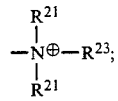

R$^{21}$, R$^{22}$ and R$^{23}$ each represents an alkyl group having 1 to 5 carbon atoms; R$^{24}$ represents a hydrogen atom or an alkyl group having 1 to 5 carbon atoms; and M represents a hydrogen atom or a cation (e.g., an alkali metal ion or an ammonium ion, etc.).

The meso-ionic compounds which are preferably used in the present invention are compounds represented by formula (IV):

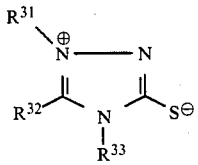

(IV)

wherein R$^{31}$ and R$^{32}$ each represents a substituted or unsubstituted alkyl group (e.g., a methyl group, an ethyl group, a 2-methoxyethyl group, a 2,2-bismethoxyethyl group, a 2-methylthioethyl group, a hydroxyethyl group, a sulfobutyl group, a carboxyethyl group, etc.), a substituted or unsubstituted alkenyl group (e.g., an allyl group, etc.), a substituted or unsubstituted cycloalkyl group (e.g., a cyclopentyl group, a cyclohexyl group, etc.), a substituted or unsubstituted aryl group (e.g., a phenyl group, a 4-methoxyphenyl group, a 4-carboxyphenyl group, a 4-methoxycarbonylphenyl group, a 3-sulfamoylphenyl group, etc.) or a substituted or unsubstituted heterocyclic group (e.g., a 2-pyridyl group, a 2-furyl group, etc.); R$^{33}$ represents a substituted or unsubstituted alkyl group (e.g., a methyl group, an ethyl group, a 2-methoxyethyl group, a 2,2-bismethoxyethyl group, a 2-methylthioethyl group, a hydroxyethyl group, a sulfobutyl group, a carboxyethyl group, etc.), a substituted or unsubstituted alkenyl group (e.g., an allyl group, etc.), a substituted or unsubstituted cycloalkyl group (e.g., a cyclopentyl group, a cyclohexyl group, etc.), a substituted or unsubstituted aryl group (e.g., a phenyl group, a 4-methoxyphenyl group, a 4-carboxyphenyl group, a 4-methoxycarbonylphenyl group, a 3-sulfamoylphenyl group, etc.), a substituted or unsubstituted aralkyl group (e.g., a benzyl group), a substituted or unsubstituted heterocyclic group (e.g., a 2-pyridyl group, a 2-furyl group, etc.) or —NR$^{34}$R$^{35}$; R$^{34}$ and R$^{35}$ each represents a hydrogen atom, an alkyl group (e.g., a methyl group, an ethyl group, etc.) or an aryl group (e.g., a phenyl group); or R$^{31}$ and R$^{32}$, or R$^{32}$ and R$^{33}$ form a 5- or 6-membered ring when taken together, respectively.

In formula (IV), R$^{31}$ and R$^{32}$ preferably contain not more than 16 total carbon atoms, and R$^{33}$ preferably contains not more than 16 total carbon atoms, and more preferably not more than 10 total carbon atoms. It is preferred that R$^{31}$, R$^{32}$ or R$^{33}$ represents a lower alkyl group having from 1 to 6 carbon atoms, or R$^{31}$ and R$^{32}$ form a ring. More preferably, R$^{31}$, R$^{32}$ or R$^{33}$ represents a lower alkyl group having from 1 to 6 carbon atoms.

The above-described compounds represented by formulae (I), (II) and (III) can be synthesized according to the methods described in the aforesaid patents or references. Some of these compounds are commercially available.

The meso-ionic compounds represented by formula (IV) can generally be synthesized by (i) anhydroacylation of 1,4-di-substituted thiosemicarbazides, (ii) heating of 4-acyl-1,4-di-substituted thiosemicarbazides, (iii) reaction between an N-aminoamidine or N-thioacylhydrazine and isothiocyanic acid, (iv) reaction between an N-aminoamidine and thiophosgene, (v) reaction between an N-aminoamidine or N-thioacylhydrazine and carbon disulfide-dicyclohexylcarbodiimide, (vi) reaction between meso-ionic 1,3,4-thiadiazole or the corresponding methiodide and a primary amine, and the like. More specifically, the compounds of formula (IV) can be synthesized according to the methods described in the following references or the methods described in references cited in the following references:

W. Baker and W. D. Ollis, *Chem. Ind.*, 910, London (1955); M. Ohta and H. Kato, *Nonbenzenoid Aromatics*, edited by J. P. Snyder; K. T. Pottas, S. K. Roy and D. P. Jones, *J. Heterocycl. Chem.*, 2, 105 (1965); K. T. Pottas, S. K. Roy and D. P. Jones, *J. Org. Chem.*, 32, 2245 (1967); G. F. Duffin, J. D. Kendall and H. R. J. Waddington, *J. Chem. Soc.*, 3799 (1959); R. L. Hinmann and D. Fulton, *J. Amer. Chem. Soc.*, 80, 1895 (1958); W. D. Ollis and C. A. Ramsden, *Chem. Commun.*, 1222 (1971); W. D. Ollis and C. A. Ramsden, *J. Chem. Soc.*, Perkin. Trans. I, 633 (1974); and R. Grayshey, M. Baumann and R. Hamprecht, *Tetrahedron Lett.*, 1939 (1972).

Synthesis examples for the compounds of formula (IV) are illustrated hereinafter for better understanding.

In the present invention, preferred sulfur-containing silver halide solvents are those represented by formulae (I), (II) and (III).

Specific examples of sulfur-containing silver halide solvents which can be used in the present invention are shown below:

$KSCN$ (1)

$NH_4SCN$ (2)

$HO(CH_2)_2S(CH_2)_2OH$ (3)

$HO(CH_2)_6S(CH_2)_5S(CH_2)_6OH$ (4)

$HO(CH_2)_2S(CH_2)_2S(CH_2)_2OH$ (5)

$HO(CH_2)_3S(CH_2)_2S(CH_2)_3OH$ (6)

$HO(CH_2)_6S(CH_2)_2S(CH_2)_6OH$ (7)

$HO(CH_2)_2S(CH_2)_2S(CH_2)_2S(CH_2)_2OH$ (8)

$HO(CH_2)_2S(CH_2)_2O(CH_2)_2O(CH_2)_2S(CH_2)_2OH$ (9)

$HOOCCH_2S(CH_2)_2SCH_2COOH$ (10)

$H_2NCO(CH_2)_2S(CH_2)_2S(CH_2)_2CONH_2$ (11)

$NaO_3S(CH_2)_3S(CH_2)_2S(CH_2)_3SO_3Na$ (12)

$HO(CH_2)_2S(CH_2)_2CONHCH_2NHCO(CH_2)_2S(CH_2)_2OH$ (13)

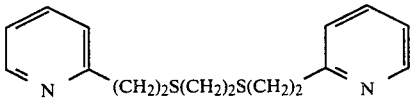

(14)

$HOCH_2\underset{\underset{OH}{|}}{C}HCH_2S(CH_2)_2SCH_2\underset{\underset{OH}{|}}{C}HCH_2OH$ (15)

$HOCH_2\underset{\underset{OH}{|}}{C}HCH_2S(CH_2)_2S(CH_2)_2S(CH_2)_2SCH_2\underset{\underset{OH}{|}}{C}HCH_2OH$ (16)

$HOOC\underset{\underset{NH_2}{|}}{C}HCH_2S(CH_2)_2SCH_2\underset{\underset{NH_2}{|}}{C}HCOOH$ (17)

$HOCH_2\underset{\underset{OH}{|}}{C}HCH_2S(CH_2)_2CONHCH_2NHCO(CH_2)_2SCH_2\underset{\underset{OH}{|}}{C}HCH_2OH$ (18)

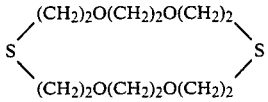

(19)

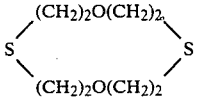

(20)

$CH_3SCH_2\underset{\underset{NH_2}{|}}{C}HCOOH$ (21)

$C_2H_5S(CH_2)_2S(CH_2)_2NHCO(CH_2)_2COOH$ (22)

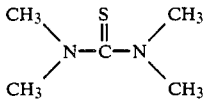

(23)

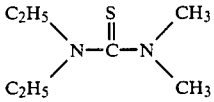

(24)

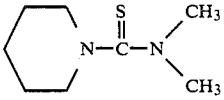

(25)

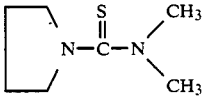

(26)

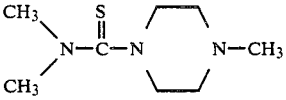

(27)

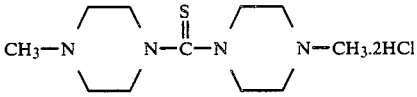

(28)

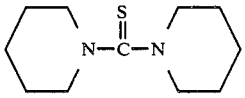

(29)

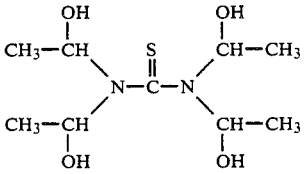

(30)

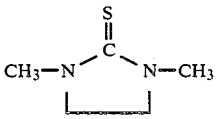

(31)

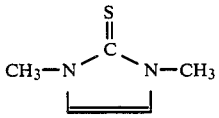

(32)

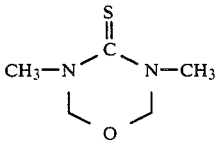

(33)

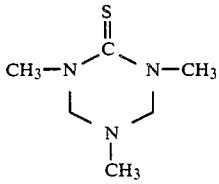

(34)

-continued
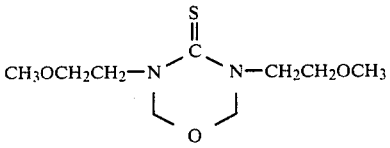
(35)
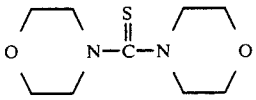
(36)
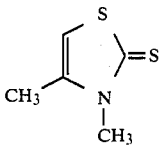
(37)
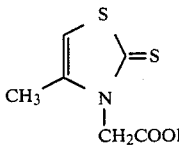
(38)
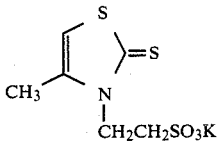
(39)
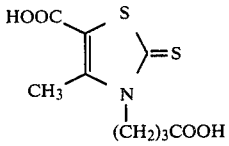
(40)
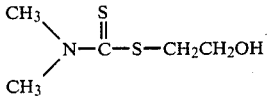
(41)
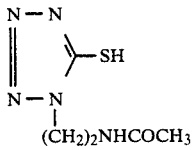
(42)
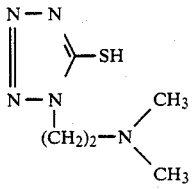
(43)
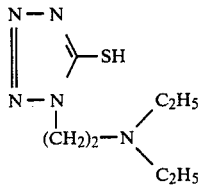
(44)
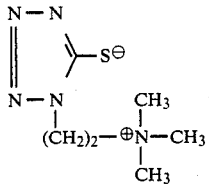
(45)
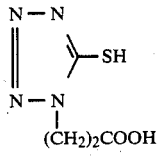
(46)
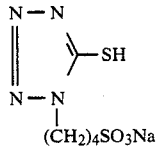
(47)
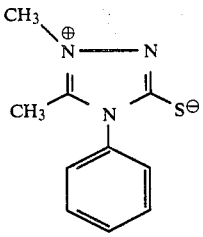
(48)
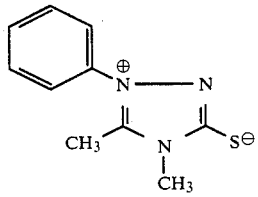
(49)
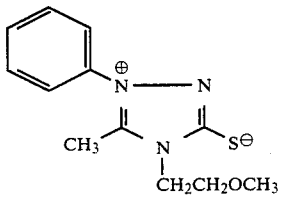
(50)

-continued
(51)
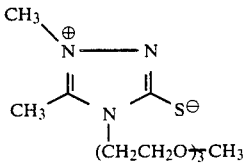
(52)
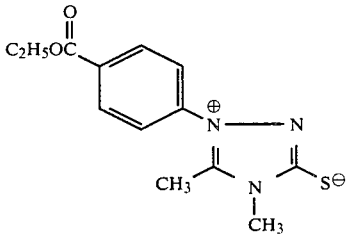
(53)
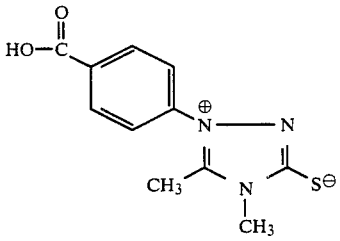
(54)
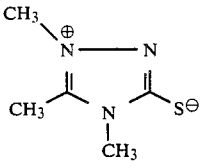
(55)
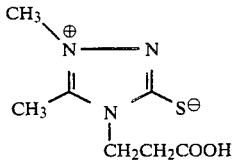
(56)
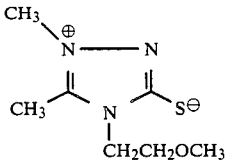
(57)
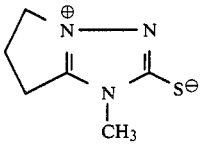
(58)
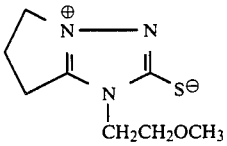
(59)
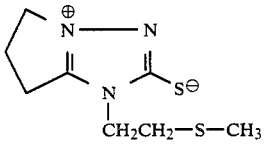
(60)
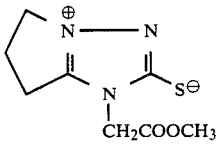
(61)
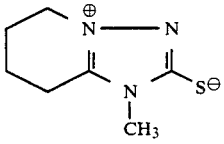
(62)
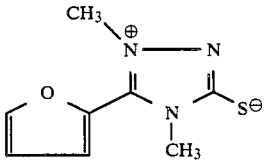
(63)
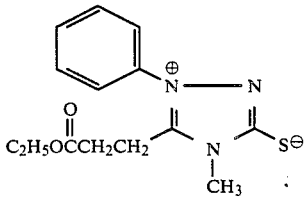
(64)
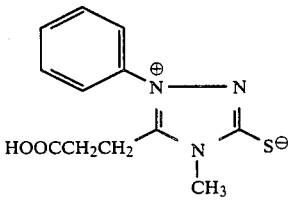
(65)
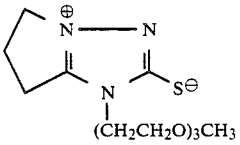
(66)
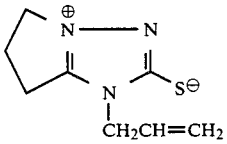

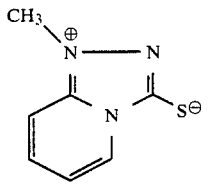

-continued

(67) 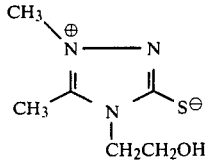

(68)

(69) 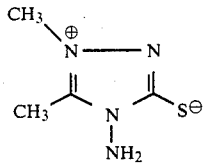

SYNTHESIS EXAMPLE 1

Synthesis of Compound No. 49

In 500 ml of benzene was dissolved 108 g of phenylhydrazine, and 73 g of methyl isothiocyanate was added dropwise to the solution, followed by heat refluxing. As the reaction proceeded, crystals were preicpitated. The thus formed crystals were filtered and dried to obtain 122 g of 4-methyl-1-phenylthiosemicarbazide.

This product can be used in the subsequent reaction without further purificatioin. 18.1 g of the 4-methyl-1-phenylthiosemicarbazide was mixed with 25 ml of acetic acid (100 wt%) at room temperature, and 25 ml of acetic anhydride was then added thereto, followed by heat refluxing for 8 hours. As the reaction proceeded, crystals were precipitated. After cooling, the thus formed crystals were filtered and recrystallized from methanol-acetic acid to obtain 13.2 g (64.4%) of Compound No. 49 as colorless crystals. Melting point: 290°-292° C.

SYNTHESIS EXAMPLE 2

Synthesis of Compound No. 50

In benzene was dissolved 11.7 g of 2-methoxyethyl isothiocyanate with stirring, and 11.9 g of phenylhydrazine was added thereto at room temperature. The resulting mixture was heat refluxed for 6 hours, followed by cooling. The thus precipitated crystals were removed by filtration to obtain 4-(2-methoxyethyl)-1-phenylthiosemicarbazide (yield: 66.7%). This product can be used in the subsequent reaction without further purification.

In 15 ml of acetic acid (100 wt%) was dissolved 10.0 g of 4-(2-methoxyethyl)-1-phenylthiosemicarbazide with stirring. To the solution was added 15 ml of acetic anhydride, and the mixture was heat refluxed for 8 hours. After completion of the reaction, the reaction mixture was cooled, and the solvent was removed by distillation. The residue was purified by silica gel chromatography and recrystallized from isopropyl alcohol-diethyl ether to obtain 2.1 g (19.0%) of Compound No. 50. Melting point: 108°-109° C.

SYNTHESIS EXAMPLE 3

Synthesis of Compound No. 57

γ-Bromoacetic acid and five times the molar quantity thereof by hydrazine hydrate was dissolved in methanol, and the solution was heat refluxed for 7 hours. The methanol was removed by distillation under reduced pressure, and the residue was subjected to column chromatography using alumina and, as an eluent, methanol/chloroform=1:20 volume. The solvent of the eluate was removed by distillation to obtain 1-amino-2-pyrrolidinone.

Ten grams of 1-amino-2-pyrrolidinone was dissolved in toluene, and 7.3 g of methyl isothiocyanate was added thereto. The reaction mixture was heat refluxed for 3 hours, followed by cooling. The precipitated crystals were filtered and dried. The resulting crystals were found to be 1-(2-pyrrolidinon-1-yl)-3-methylthiourea of NMR and Mass spectra.

Fourteen grams of 1-(2-pyrrolidinon-1-yl)-3-methylthiourea was added to 20 ml of acetic acid (100 wt%), followed by stirring. Then, 20 ml of acetic anhydride was added thereto, and the mixture was heat refluxed. After completion of the reaction, the solvent was removed by distillation, and the residue was recrystallized from ethanol to give 3.4 g (27.1%) of Compound No. 57. Melting point: 257°-259° C.

SYNTHESIS EXAMPLE 4

Synthesis of Compound Nos. 64 and 65

With 100 ml of toluene was mixed 18.1 g of 4-methyl-1-phenylthiosemicarbazide as prepared in Synthesis Example 1, and 18.1 g of β-carboethoxypropionyl chloride was added thereto. The mixture was heated at 80° C. for 3 hours and then cooled to obtain crystals of 4-methyl-1-phenyl-1-(β-carboethoxypropionyl)thiosemicarbazide. Ten grams of the product was suspended in 70 ml of ethanol, followed by heat refluxing, and a small amount of sodium ethoxide was added to the reaction mixture. The reaction mixture once became uniform, and then crystals precipitated. After cooling, the thus formed crystals were removed by filtration and dried to obtain 16.0 g (55%) of Compound No. 64. Melting point: 162°-163° C.

Ten grams of Compound No. 64 was added to 20 ml of 6N hydrochloric acid, and 40 ml of ethanol was added thereto. The resulting suspension was heat refluxed for 1 hour to form a uniform solution. The reaction mixture was dried to a solid and recrystallized from ethanol to obtain 5.5 g (60.9%) of Compound No. 65. Melting point: 223°-225° C.

Some of compounds (IV) according to the present invention are known in the photographic field as disclosed in EPC 54415A1, etc., but they have been used as stabilizers for heat-developable silver halide light-sensitive materials or fixing agents for photographic development processing and, therefore, are entirely different from the compounds of the present invention in terms of objects, effects and the stage in which the compounds are used.

The effect on growing silver halide grains brought about by these sulfur-containing silver halide solvents can be reduced or inactivated by using an oxidizing agent.

The oxidizing agents which can be used include inorganic oxidizing agents and organic oxidizing agents.

Specific examples of inorganic oxidizing agents are hydrogen peroxide (aqueous solution), addition products of hydrogen peroxide (e.g., $NaBO_2.H_2O_2$, $2NaCO_3.3H_2O_2$, $Na_4P_2O_7.2H_2O_2$, $2Na_2SO_4.H_2O_2.2H_2O$, etc.), peroxy acid salts (e.g., $K_2S_2O_8$, $K_2C_2O_6$, $K_4P_2O_8$, etc.), peroxy complex compounds (e.g., $K_2Ti(O_2)C_2O_4.3H_2O$, $4.K_2SO_4.Ti(O_2)OH.SO_4.2H_2O$, $Na_3VO(O_2)(C_2O_4)_2.6H_2O$, etc.), oxyacid salts such as permanganates (e.g., $KMnO_4$, etc.) and chromates (e.g., $K_2Cr_2O_7$, etc.) and the like.

Organic oxidizing agents include organic peroxides such as peracetic acid, perbenzoic acid, etc.

In addition, oxidizing gases (e.g., ozone, oxygen gas, etc.) and oxidizing compounds such as those capable of releasing halogens (e.g., sodium hypochlorite, N-bromosuccinimide, chloramine B (sodium benzenesulfonchloramide), chloramine T (sodium p-toluenesulfonchloramide), etc.) can be used.

Oxidizing agents suitable for achieving the objects of the present invention can be selected in accordance with the method described in Example 1, 2, 10 or 11 hereinafter given. Preferred oxidizing agents are those which eliminate the grain growth effect of the sulfur-containing silver halide solvents and at the same time do not decompose gelatin or do not have a strong desensitizing effect. These characteristics of oxidizing agents can be evaluated by examining photographic properties in a conventional manner or in accordance with the method described in Example 1, 2, 10 or 11. More specifically, the oxidizing agent used in the present invention is an organic or inorganic compound which is capable of oxidizing the sulfur-containing silver halide solvent when it is used in an amount of 3,000 or more molar times the amount of the sulfur-containing silver halide solvent at 50° C. Also, oxidizing agents where the oxidation-reduction potential of the sulfur-containing silver halide solvent is negative can be advantageously used.

Some of the oxidizing agents decompose gelatin or exhibit a strong desensitizing effect (especially, oxidizing compounds which release halogens are associated with these adverse effects). When such oxidizing agents are employed in the present invention, it is necessary to reduce the amounts thereof to be added.

Among the above-described oxidizing agents, the inorganic oxidizing agents and oxidizing gases are preferred, with the inorganic oxidizing agents being particularly preferred. Of the inorganic oxidizing agents, hydrogen peroxide or adducts or precursors thereof are particularly preferred.

These oxidizing agents can easily be synthesized and most of them are commercially available.

In the present invention, the oxidizing agent can be used in the presence of a catalyst which serves to promote oxidation reaction of the sulfur-containing silver halide solvent with an oxidizing agent. Such catalysts include metal salts or oxides, such as tungsten salts or oxides (e.g., sodium tungstate, tungsten trioxide, etc.), vanadium salts or oxides (e.g., pervanadic acid, vanadium pentoxide, etc.), osmium salts or oxides (e.g., osmium tetroxide, etc.), molybdenum salts, manganese salts, iron salts, copper salts, etc., selenium dioxide, enzymes (e.g., catalase, etc.), and the like. These catalysts may be added to a system before, simultaneously, or after the addition of the oxidizing agent and can be added usually in an amount of 10 mg to 1 g per mol of silver.

In carrying out the present invention, the oxidizing agent can be used in the presence of a salt other than silver salts and halogen salts for the purpose of preventing any damages (e.g., corrosion) of a metal reactor with the oxidizing agent. Such salts include inorganic salts, such as nitrates (e.g., potassium nitrate, ammonium nitrate, etc.), sulfates (e.g., potassium sulfate, sodium sulfate, etc.), phosphates, etc., and organic salts (e.g., potassium acetate, sodium acetate, potassium citrate, etc.). These salts can previously be added to a silver salt aqueous solution or a halogen salt aqueous solution, and are usually used in an amount of from 1 to 20 g per mol of silver.

Hydrogen peroxide which can be used as an oxidizing agent in the present invention may be used in combination with a stabilizer, such as phosphoric acid, barbituric acid, uric acid, acetanilide, oxyquinoline, sodium pyrophosphate, sodium stannate, etc.

The amount of the sulfur-containing silver halide solvent used in the present invention can arbitrarily be determined, but is preferably from $10^{-5}$ to $5\times10^{-1}$ mol, and more preferably $3\times10^{-4}$ to $10^{-1}$ mol, per mol of silver halide. The sulfur-containing silver halide solvent can be used at a temperature of from about 25° C. to about 95° C., preferably 30° C. to 90° C.

The amount of the oxidizing agent can be determined in conformity with the amount of the sulfur-containing silver halide solvent. When complete inactivation of the grain growth effect is required, the oxidizing agent should be added in at least stoichiometrically equivalent amount to the sulfur-containing silver halide solvent. When inactivation should be effected to a requisite extent, the amount of the oxidizing agent is adjusted accordingly. For example, the oxidizing agent can be used in an amount ranging of from 1/100 to 3,000 molar times, preferably of from 1/100 to 500 molar times, and more preferably of from 1/50 to 100 molar times, based on the silver halide solvent.

The silver halide solvent and the oxidizing agent can be added to a system in the form of a solution in water or a water-soluble organic solvent, such as alcohols, ethers, glycols, ketones, esters, amides, etc.

Since the reaction between the sulfur-containing silver halide solvent and the oxidizing agent can be controlled by temperature and/or addition of catalyst, etc., incorporation of the oxidizing agent may be conducted before and/or after the addition of the sulfur-containing silver halide solvent, but is preferably conducted after the addition of the silver halide solvent. The incorporation of the oxidizing agent may be effected in any stage from the formation of silver halide crystals to immediately before coating. Basically, the oxidizing agent is added to a system at a point when the photographically useful function of the sulfur-containing silver halide solvent becomes unnecessary. When the grains are subjected to chemical ripening with chemical sensitizers, it is preferable to add the oxidizing agent by the stage of the chemical ripening.

Preferred embodiments for the method of using the sulfur-containing silver halide solvent and the oxidizing agent according to the present invention are described below.

(1) Silver nitrate and/or a halide such as sodium chloride, potassium bromide, potassium iodide, etc., is/are added to a system previously containing the sulfur-containing silver halide solvent to thereby accelerate growth of silver halide grains. During or after the growth of the silver halide grains, the oxidizing agent is allowed to act. In the latter case (i.e., after the growth of grains), the oxidizing agent may be added to any stage, e.g., immediately after the growth of grains, after physical ripening, at the stage of washing with water, at the stage of chemical ripening (preferably before the start of the chemical ripening), and the like.

(2) Either during or after the formation of growth of silver halide grains caused by addition of silver nitrate and/or a halide, the sulfur-containing silver halide solvent is added to the system. Thereafter, the oxidizing agent is allowed to act after physical ripening, in the stage of washing with water or at the stage of chemical ripening (preferably before the start of chemical ripening), (3) After silver nitrage and/or a halide is/are added to a system previously containing the sulfur-containing silver halide solvent to thereby form or growth silver halide grains, or after the sulfur-containing silver halide solvent is added to a system in the course of the formation or growing of silver halide grains to thereby form or grow grains, the oxidizing agent is added to the system. During or after the addition of the oxidizing agent, silver nitrate and/or a halide is/are added thereto so as to prevent regeneration of nuclei, to thereby form multistructure grains. If the above-described procedures are repeated, multilayered grains can easily be obtained.

In the present invention, the aforesaid conspicuous effects can be accomplished by the use of the oxidizing agent and the sulfur-containing silver halide solvent at a specific stage. A probable assumption accounting for the mechanism of inactivation of the sulfur-containing silver halide solvent is as follows.

In the case when the silver halide solvents are thioether compounds, —S— is oxidized to —SO— or —$SO_2$— and they are thereby rendered unable to coordinate to silver ions. In fact, Example 1 of the present invention hereinafter given clearly demonstrates that the comparative compounds, which are oxidized products of thioether compounds, do not at all possess an effect to accelerate growth of silver halide grains. In the said manner, it is assumed that the thiocyanates, the thione compounds and the meso-ionic compounds (IV) become unable to coordinate to silver ions upon being oxidized, thereby losing their grain growth effect.

Thus, the method according to the present invention can be applied to sulfur-containing silver halide solvents which exhibit an effect of accelerating the growth of silver halide grains due to the coordination of their sulfur atoms to silver ions.

The present invention makes it possible to prevent or reduce the incorporation of the sulfur-containing silver halide solvent into the stage of chemical ripening by the use of the aforesaid oxidizing agent, whereby the unfavorable effects of silver halide solvents on chemical ripening can be eliminated or at least reduced. Further, in some cases, the present invention is effective to prevent a reduction in contrast or prevent hingering the adsorption of various additives such as sensitizing dyes.

Furthermore, by using the aforesaid oxidizing agent during or after the formation or growth of silver halide grains, the effect of the sulfur-containing silver halide solvent can be controlled so that multilayer grains can easily be produced. In addition, the present invention also makes it possible to easily produce monodispersed grains.

Further, when the oxidizing agent according to the present invention is used in a large quantity, excessive oxidizing agent can be inactivated by adding a reducing substance which serves to reduce the oxidizing agent used (e.g., sulfites, sulfinic acids, reducing sugars, etc.) at an appropriate stage so as to prevent any adverse influence on subsequent chemical ripening and the like.

The reducing substance is preferably used before the start of the chemical ripening and more preferably after the addition of the oxidizing agent and before the start of the chemical ripening.

The amount of the reducing substance is properly determined depending on the type of the oxidizing agent used or the desired degree of inactivation, but is usually at least equimolar based on the oxidizing agent, and preferably ranges from 1 to 50 mols per mol of the oxidizing agent.

The use of an oxidizing agent in preparing a silver halide emulsion has hitherto been known. For example, in the production of heat-developable light-sensitive materials, it is known to use an oxidizing agent capable of releasing halogen in the step called halogenation in which a silver halide is prepared from a silver carbonate. Further, it is also known to use an oxidizing agent in usual halide emulsions or the aforesaid heat-developable light-sensitive materials in order to prevent fog as described in, for example, Japanese Patent Publication Nos. 40484/78 and 35488/79 and Japanese Patent Application (OPI) Nos. 4821/77, 10724/74 and 45718/74. However, the oxidizing agents used in these reference completely differ from those used in the present invention in terms of object and effect.

Silver halides which can be used in the photographic emulsions of the present invention include silver bromide, silver iodobromide, silver iodochlorobromide, silver chlorobromide, silver iodide and silver chloride.

Grain size distribution may be either broad or narrow.

Silver halide grains in the photographic emulsions may have a regular crystal form such as a cube, an octahedron, a tetradecahedron, a rhombic dodecahedron, etc., an irregular crystal form such as a sphere, a plate, etc., or a composite form thereof. Silver halide grains may be a mixture of grains having various crystal forms.

The individual silver halide grains may comprise a core and an outer shell or may be homogeneous.

Further, the silver halide grains may also include junction type silver halide crystals composed of an oxide crystal (e.g., PbO) and a silver halide crystal (e.g., silver chloride), epitaxially grown silver halide crystals (e.g., a silver bromide crystal on which silver chloride, silver iodobromide, silver iodide, etc., is epitaxially grown) and crystals of hexagonal silver iodide on which hexahedral silver chloride is orientatedly over grown.

The silver halide grains in the photographic emulsion can have an optional grain size distribution and may be a monodispersed. The term "monodispersed" herein means a dispersion system wherein more than 95% of the total silver halide grains is included in the size range within ±60%, preferably ±40%, of the number mean grain size. The term "number mean grain size" herein used means the number mean diameter of the projected areas of the total silver halide grains.

The photographic emulsions according to the present invention can be prepared by the methods as described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. That is, photographic emulsions can be prepared according to any of the acid process, the neutral process, the ammonia process, and the like. Methods for reacting a water-soluble silver salt with a water-soluble halide include a single jet method, a double jet method and a combination thereof.

In addition, a method in which silver halide grains are produced in the presence of excess silver ions (the reverse mixing method) can also be employed. Further, the controlled double jet method, in which the pAg of the liquid phase wherein silver halide grains are to be precipitated is maintained constant, may also be employed. According to this method, silver halide emulsions in which grains have a regular crystal form and an almost uniform size distribution can be obtained.

Two or more silver halide emulsions prepared separately may be used in the form of a mixture.

In the formation of silver halide grains or physical ripening of the grains, cadmium salts, zinc salts, lead salts, thallium salts, iridium salts or complexes thereof, rhodium salts or complexes thereof, iron salts or complexes thereof and the like may be present. The amount of these salts or complexes may be either small or large depending on the desired light-sensitive material.

Removal of soluble salts from the silver halide emulsion after the formation of silver halide grains or physical ripening can be effected by the noodle washing method comprising gelling the gelatin or a sedimentation (or flocculation) method using an inorganic salt, an anionic surface active agent, an anionic polymer (e.g., polystyrenesulfonic acid) or a gelatin derivative (e.g., acylated gelatin, carbamoylated gelatin, etc.).

The silver halide emulsion may or may not be chemically sensitized. Chemical sensitization can be carried out using processes as described in, for example, H. Frieser (ed.), *Die Grundlagen der Photographischen Prozesse mit Silberhalogeniden,* pp. 675–734, Akademische Verlagsgesellschaft (1968).

More specfically, chemical sensitization can be carried out by sulfur sensitization using compounds containing sulfur capable of reacting with active gelatin or silver ions (e.g., thiosulfates, thioureas, mercapto compounds, rhodanines, etc.), reduction sensitization using reducing materials (e.g., stannous salts, amines, hydrazine derivatives, formamidinesulfinic acid, silane compounds, etc.), noble metal sensitization using noble metal compounds (e.g., gold complexes and complexes of Periodic Table Group VIII metals such as Pt, Ir, Pd, etc.) or a combination thereof.

Specific examples of sulfur sensitizations are described in U.S. Pat. Nos. 1,574,944, 2,410,689, 2,278,947, 2,728,668 and 3,656,955, etc. Specific examples of reduction sensitizations are described in U.S. Pat. Nos. 2,983,609, 2,419,974 and 4,054,458, etc. Specific examples of noble metal sensitizations are given in U.S. Pat. Nos. 2,399,083 and 2,448,060, British Pat. No. 618,061, etc.

Photographic emulsions according to the present invention can contain various compounds for the purpose of preventing fog in preparation, storage or photographic processing, or for stabilizing photographic properties. Such compounds include azoles, such as benzothiazolium salts, nitroindazoles, triazoles, benzotriazoles, benzimidazoles (particularly nitro- or halogen-substituted ones); heterocyclic mercapto compounds, such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines; the above-described heterocyclic mercapto compounds having water-soluble groups such as a carboxyl group, a sulfonyl group or a like group; thioketo compounds, such as oxazolinethione; azaindenes, such as tetraazaindenes (particularly 4-hydroxy-substituted (1,3,3a,7)tetraazaindenes); benzenethiosulfonic acids; benzenesulfinic acids; and many other compounds known as antifoggants or stabilizers.

For details of these compounds, disclosure given in, for example, E. J. Birr, *Stabilization of Photographic Silver Halide Emulsions,* Focal Press (1974) can be referred to.

Photographic emulsions of the light-sensitive materials of the present invention may be spectrally sensitized to blue light, green light or red light having relatively long wavelengths or infrared ray using sensitizing dyes. Sensitizing dyes which can be used for spectral sensitization include cyanine dyes, merocyanine dyes, complex cyanine dyes, complex merocyanine dyes, holopolar cyanine dyes, styryl dyes, hemicyanine dyes, oxonol dyes, hemioxonol dyes and the like. Specific examples of the spectral sensitizing dyes are described in, for example, P. Glafkides, *Chimie Photographique,* 2nd Ed., Chapters 35–41, Paul Montel, Paris (1957), F. M. Hamer, *The Cyanine and Related Compounds,* Interscience, U.S. Pat. Nos. 2,503,776, 3,459,553 and 3,177,210 and *Research Disclosure,* Vol. 176 (RD-17643), Item 23 IV-J (December, 1978).

Hydrophilic collidal layers of the light-sensitive materials prepared by the present invention con contain water-soluble dyes as filter dyes or for various purposes including prevention of irradiation. Such dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

Photographic emulsions and other hydrophilic colloidal layers of the photographic light-sensitive materials of the present invention may contain inorganic or organic hardeners. Examples of the hardeners which can be used include chromium salts (e.g., chromium alum, chromium acetate, etc.), aldehydes (e.g., formaldehyde, glyoxal, glutaraldehyde, etc.), N-methylol compounds (e.g., dimethylolurea, methyldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) and the like. These hardeners can be used alone or as a combination of two or more of them.

Photographic emulsion layers or other hydrophilic colloidal layers of the light-sensitive materials according to the present invention may contain various surface active agents for a wide variety of purposes, such as for assistance of coating, prevention of static charge, improvement of slipping properties, assistance of emulsion dispersing, prevention of adhesion, improvement of photographic properties (e.g., acceleration of development, increase in contrast and sensitivity, etc.) and the like.

Examples of surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic polyglycerides, alkylphenol polyglycerides, etc.), fatty acid esters of polyhydric alcohols, alkyl esters of sugars, etc.; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, ankylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Photographic emulsions of the photographic light-sensitive materials according to the present invention may contain, for example, polyalkylene oxides or derivatives thereof (e.g., ethers, esters, amines, etc.), thioether compounds, thiomorpholines, quaternary ammonium salt compounds, urethane derivatives, urea derivatives, imidazole derivatives, 3-pyrazolidones and the like for the purpose of increasing sensitivity or contrast or accelerating development. Specific examples of such compounds are disclosed in, for example, U.S. Pat. Nos. 2,400,532, 2,423,549, 2,716,062, 3,617,280, 3,772,021 and 3,808,003 and British Pat. No. 1,488,991, etc.

Binders or protective colloids which can be used in emulsion layers or intermediate layers of the photographic light-sensitive materials of the present invention include gelatin to advantage, but other hydrophilic colloids can also be employed. For example, usable hydrophilic colloids include proteins, such as gelatin derivatives, graft polymers of gelatin and other high polymers, albumin, casein, etc.; cellulose derivatives, such as hydroxyethyl cellulose, carboxymethyl cellulose, cellulsoe sulfates, etc.; sugar derivatives such as sodium alginate, starch derivatives, etc.; and a wide variety of synthetic hydrophilic high molecular weight polymers, such as polyvinyl alcohol, partially acetylated polyvinyl alcohol, poly-N-vinylpyrrolidone, polyacrylic acid, polymethacrylic acid, polyacrylamide, polyvinylimidazole, polyvinylpyrazole, etc., and copolymers containing comonomers which constitute the above-described polymers.

Photographic emulsion layers of the photographic light-sensitive materials according to the present invention can contain color forming couplers, i.e., compounds capable of forming color by oxidative coupling with aromatic primary amine developers (e.g., phenylenediamine derivatives, aminophenol derivatives, etc.) in color development processing. For example, such color forming couplers include magenta couplers, such as 5-pyrazolone couplers, pyrazolobenzimidazole couplers, cyanoacetylcumarone couplers, open chain acylacetonitrile couplers, etc.; yellow couplers, such as acylacetamide couplers (e.g., benzoylacetanilides, pivaloylacetanilides, etc.), etc.; and cyan couplers, such as naphthol couplers, phenol couplers, etc. It is preferable that these couplers have hydrophobic groups called ballast groups in their molecule and are thereby rendered nondiffusible. The couplers may be either 4-equivalent or 2-equivalent with respect to silver ions. Moreover, they may be colored couplers having a color correcting effect or couplers capable of releasing development inhibitors with the progress of development (DIR couplers).

In addition to the DIR couplers, colorless DIR coupling compounds which yield colorless products upon coupling and release development inhibitors may also be used.

The light-sensitive materials prepared in accordance with the present invention may contain hydroquinone derivatives, aminophenol derivatives, gallic acid derivatives, ascorbic acid derivatives, etc., as color fog preventing agents.

Hydrophilic colloidal layers of the light-sensitive materals prepared in accordance with the present invention may contain ultraviolet absorbents. Examples of ultraviolet absorbents which can be used include, for example, benzotriazole compounds substituted with aryl groups as described in U.S. Pat. No. 3,533,794; 4-thiazolidone compounds as described in U.S. Pat. Nos. 3,314,794 and 3,352,681; benzophenone compounds as described in Japanese Patent Application (OPI) No. 2784/71; cinnamic acid esters as described in U.S. Pat. Nos. 3,705,805 and 3,707,375; butadiene compounds as described in U.S. Pat. No. 4,045,229; benzoxazole compounds as described in U.S. Pt. No. 3,700,455 and ultraviolet absorbents as described in U.S. Pat. No. 3,499,762 and Japanese Patent Application (OPI) No. 48535/79. Ultraviolet absorbing couplers (e.g., α-naphthol type cyan forming couplers) or ultraviolet absorbing polymers may also be used. These ultraviolet absorbents may be mordanted in a specific layer.

In carrying out the present invention, the following known discoloration inhibitors can be used in combination. Further, color image stabilizing agents can be used individually or as a combination of two or more thereof. Examples of known discoloration inhibitors include hydroquinone derivatives, gallic acid derivatives, p-alkoxyphenols, p-oxyphenol derivatives and bisphenols.

Silver halide photographic emulsions according to the present invention can further contain other various additives, such as whitening agents, densensitizing agents, plasticizers, lubricants, matting agents, oils, mordants and the like.

Specific examples of these additives are given in *Research Disclosure* (RD-17643), No. 176, pp. 22–31 (December, 1978), etc.

Photographic emulsions prepared by the present invention can be used in various color and monochromatic silver halide light-sensitive materials, such as color positive materials, color papers, color negative materials, color reversal materials (the emulsion to be used may or may not contain couplers), photographic light-sensitive materials for print making (e.g., lith films), light-sensitive materials for CRT display, light-sensitive materials for X-ray recording (particularly, screen type films and non-screen type films), printout materials and heat-developable light-sensitive materials.

The emulsions according to the present invention can also be employed in a colloid transfer process, a silver salt diffusion transfer process, a dye transfer process, a silver dye bleaching process, etc.

Exposure for obtaining a photographic image can be carried out in a conventional manner. For example, any of various known light sources (including infrared rays), such as natural light (sunlight), a tungsten lamp, a fluorescent lamp, a mercury lamp, a xenon arc lamp, a carbon arc lamp, a xenon flash lamp, a cathode ray tube flying spot, a luminous diode, laser beams (e.g., a gas laser, YAG laser, dye laser, semiconductor laser, etc.) and the like can be used. The exposure may also be effected using light emitted from fluorescent substances excited by electron beams, X-rays, $\gamma$-rays, $\alpha$-rays, etc. Suitable exposure times which can be used include not only exposure times commonly used in cameras ranging from about 1/1,000 to about 1 sec, but also exposure times shorter than 1/1,000 sec, e.g., about $1/10^4$ to about $1/10^6$ sec as with xenon flash lamps or cathode ray tubes. Exposure times longer than 1 sec can also be used. The spectral composition of the light employed for exposure can be controlled using color filters, if desired.

Photographic processing of the light-sensitive materials according to the present invention can be carried out by known methods with known processing solutions as described in, for example, *Research Disclosure* (RD-17643), No. 176, pp. 28–30. Any photographic processing, whether for the formation of silver images (monochromatic photograhic processing) or for the formation of dye images (color photographic processing), can be employed according to the end use of the light-sensitive material. Processing temperatures are generally selected from the range of from 18° C. to 50° C., but temperatures lower than 18° C. or higher than 50° C. may also be used.

In some cases, other known developing methods, such as heat development, can be employed.

The present invention will now be illustrated in greater detail with reference to examples, but it should be understood that the present invention is not to be limited thereto. In the examples, all percents are given by weight unless otherwise indicated.

EXAMPLE 1

To Solution I having the following composition which was kept at 50° C. with vigorous stirring were added dropwise 20 ml of a 1N aqueous solution of silver nitrate and 20 ml of a 1M aqueous solution of potassium bromide simultaneously over a period of 30 minutes.

| Solution I | |
|---|---|
| Inactive Gelatin | 3 g |
| Potassium Bromide | 180 ml |
| Water | 100 ml |

A silver halide solvent was added to Solution I prior to addition of the other chemicals, and an oxidizing agent was added 5 minutes before the addition of the silver nitrate solution and the potassium bromide solution. The kinds and amounts of the silver halide solvent and oxidizing agent added are shown in Table 1.

Immediately after the addition of silver nitrate and potassium bromide, the mixture was sampled, and the size of silver halide crystals thus formed was determined by the use of an electron microscope. The results obtained are shown in Table 1.

As is apparent from Table 1, the presence of silver halide solvents produces larger silver halide crystals, but the addition of the oxidizing agent(s) reduces or eliminates the grain growth effect of the sulfur-containing silver halide solvents. This is a surprising finding that was not heretofore known.

On the other hand, when ammonia is used as a silver halide solvent, the grain growth effect thereof naturally disappears upon neutralization with an acid, but cannot be eliminated by the addition of the oxidizing agent.

Further, when only the oxidizing agent was added, the resulting silver halide crystals had a mean grain size of 0.18 $\mu$m, that is the same as that of Emulsion No. 1.

TABLE 1

| Emulsion | Silver Halide Solvent | | Oxidizing Agent | | Mean Grain Size |
|---|---|---|---|---|---|
| No. | Kind | Amount* (mmol) | Kind | Amount* | ($\mu$m) |
| 1 | — | — | — | — | 0.18 |
| 2 | (5) | 0.3 | — | — | 0.52 |
| 3 | " | " | $H_2O_2$ (35%) | 0.5 cc | 0.26 |
| 4 | " | " | " | 2.5 cc | 0.18 |
| 5 | " | " | $NaBO_2.H_2O_2.3H_2O$** | 50 mg | 0.38 |
| 6 | " | " | " | 210 mg | 0.18 |
| 7 | " | " | $K_2S_2O_8$ | 210 mg | 0.18 |
| 8 | " | 0.6 | — | — | 0.75 |
| 9 | " | " | $H_2O_2$ (35%) | 2.5 cc | 0.18 |
| 10 | (6) | 0.2 | — | — | 0.55 |
| 11 | " | " | $H_2O_2$ (35%) | 2.8 cc | 0.18 |
| 12 | " | " | $NaBO_2.H_2O_2.3H_2O$ | 200 mg | 0.18 |
| 13 | (9) | 0.1 | — | — | 0.35 |
| 14 | " | " | $H_2O_2$ (35%) | 2.0 cc | 0.18 |
| 15 | (14) | 0.1 | — | — | 0.32 |
| 16 | " | " | $H_2O_2$ (35%) | 2.0 cc | 0.18 |
| 17 | (15) | 0.6 | — | — | 0.58 |
| 18 | " | " | $NaBO_2.H_2O_2.3H_2O$ | 350 mg | 0.21 |
| 19 | (19) | 0.5 | — | — | 0.60 |
| 20 | " | " | $NaBO_2.H_2O_2.3H_2O$ | 350 mg | 0.18 |
| 21 | " | " | $KMnO_4$ | 250 mg | 0.18 |
| 22 | (23) | 0.5 | — | — | 0.45 |
| 23 | " | " | $H_2O_2$ (35%) | 2.8 cc | 0.18 |
| 24 | (25) | 0.5 | — | — | 0.57 |
| 25 | " | " | $H_2O_2$ (35%) | 2.8 cc | 0.18 |
| 26 | (31) | 1 | — | — | 0.48 |

TABLE 1-continued

| Emulsion No. | Silver Halide Solvent Kind | Silver Halide Solvent Amount* (mmol) | Oxidizing Agent Kind | Oxidizing Agent Amount* | Mean Grain Size (μm) |
|---|---|---|---|---|---|
| 27 | " | " | $K_2S_2O_8$ | 540 mg | 0.20 |
| 28 | (33) | 0.5 | — | — | 0.51 |
| 29 | " | " | $NaBO_2.H_2O_2.3H_2O$ | 350 mg | 0.18 |
| 30 | (37) | 0.6 | — | — | 0.39 |
| 31 | " | " | $NaBO_2.H_2O_2.3H_2O$ | 350 mg | 0.18 |
| 32 | (44) | 0.4 | — | — | 0.41 |
| 33 | " | " | $NaBO_2.H_2O_2.3H_2O$ | 350 mg | 0.20 |
| 34 | (45) | 0.4 | — | — | 0.77 |
| 35 | " | " | $NaBO_2.H_2O_2.3H_2O$ | 350 mg | 0.28 |
| 36 | (1) | 3 | — | — | 0.45 |
| 37 | " | " | $H_2O_2$ (35%) | 1 cc | 0.22 |
| 38 | " | " | " | 3 cc | 0.18 |
| 39 | " | " | $O_3$ gas blown for 10 minutes | | 0.25 |
| 40 | $NH_3$ | 12 | — | — | 0.65 |
| 41 | " | " | $H_2O_2$ (35%) | 1 cc | 0.65*** |
| 42 | " | " | " | 5 cc | 0.64*** |
| 43 | $NH_3$ | 12 | Neutralization with glacial acetic acid | | 0.18 |
| 44 | Comparative Compound (a)**** | 0.6 | — | — | 0.18 |
| 45 | Comparative Compound (b)**** | 0.6 | — | — | 0.18 |

Note:
*per 0.02 mol $AgNO_3$
**Increase in pH level by the addition of $NaBO_2.H_2O_2.3H_2O$ was corrected by adding acetic acid. Hereinafter the same in the case of using $NaBO_2.H_2O_2.3H_2O$.
***Slight reduction in pH level by the addition of $H_2O_2$ was corrected by sodium hydroxide.
****(a) $HO—(CH_2)_2SO(CH_2)_2SO(CH_2)_2OH$
(b) $HO—(CH_2)_2SO_2(CH_2)_2SO_2(CH_2)_2OH$ Further, the same procedures as described above were repeated except for using Comparative Compound (a) or (b), which is an oxidized product of Compound (5), in place of the sulfur-containing silver halide solvent of the present invention. The results shown in Table 1 proved that these comparative compounds do not exhibit an effect of increasing the size of silver halide crystals as predicted.

EXAMPLE 2

Each of Emulsion Nos. 1, 2, 8, 22 and 36 prepared in Example 1 was divided in two, and one was heated to 70° C. and stirred for 20 minutes. To the other was added an oxidizing agent, and the system was heated to 70° C. followed by stirring for 20 minutes. The size of the silver halide crystals in each two divided emulsions was compared with that before the heating. The results obtained are shown in Table 2.

From Table 2, it can be seen that the sulfur-containing silver halide solvents accelerate physical ripening of silver halide grains to produce grains of larger size, but such a grain growth effect of the sulfur-containing silver halide solvents disappears by the addition of the oxidizing agents according to the present invention.

TABLE 2

| Emulsion No. | Oxidizing Agent Kind | Oxidizing Agent Amount** | Mean Grain Size before Heating* (μm) | Mean Grain Size after Heating (μm) |
|---|---|---|---|---|
| 1 | — | — | 0.18 | 0.21 |
| " | $NaBO_2.H_2O_2.3H_2O$ | 105 mg | " | 0.21 |
| 2 | — | — | 0.52 | 0.78 |
| " | $K_2S_2O_8$ | 105 mg | " | 0.55 |

TABLE 2-continued

| Emulsion No. | Oxidizing Agent Kind | Oxidizing Agent Amount** | Mean Grain Size before Heating* (μm) | Mean Grain Size after Heating (μm) |
|---|---|---|---|---|
| 8 | — | — | 0.75 | 1.1 |
| " | $H_2O_2$ (35%) | 1.3 cc | " | 0.80 |
| 22 | — | — | 0.45 | 0.62 |
| " | $H_2O_2$ (35%) | 1.4 cc | " | 0.48 |
| 36 | — | — | 0.45 | 0.58 |
| " | $H_2O_2$ (35%) | 2 cc | " | 0.47 |

Note:
*The mean grain size before heating was taken from the results of Table 1.
**per 0.01 mol $AgNO_3$

EXAMPLE 3

The same procedures as described in Example 1 were applied to a silver chloride emulsion by replacing potassium bromide in Solution I with an equimolar amount of sodium chloride.

As a result, the grain growth effect of sulfur-containing silver halide solvent (5) or (23) could be eliminated by the oxidizing agent (i.e., hydrogen peroxide or $K_2S_2O_8$).

EXAMPLE 4

The same procedures as described in Example 1 were applied to a silver iodobromide emulsion (iodine content: 4 mol%) by replacing a part of potassium bromide in Solution I with potassium iodide.

As a result, the grain growth effect of sulfur-containing silver halide solvent (5) or (19) could be eliminated by using hydrogen peroxide, which is an oxidizing agent according to the present invention, in a manner similar to Example 1.

EXAMPLE 5

Solutions III and IV having the following compositions were simultaneously added dropwise to Solution II having the following composition kept at 75° C. with vigorous stirring over a period of 4 minutes. The stirring was continued for 10 minutes at 75° C., and then Solutions V and VI having the following compositions were simultaneously added thereto dropwise over a period of 60 minutes to prepare a silver halide emulsion.

| | |
|---|---|
| Solution II | |
| Inactive Gelatin | 25 g |
| Potassium Iodide | 9.5 g |
| Water | 600 ml |
| Solution III | |
| Silver Nitrate | 25 g |
| Water | 300 ml |
| Solution IV | |
| Potassium Bromide | 17.5 g |
| Water | 150 ml |
| Solution V | |
| Silver Nitrate | 125 g |
| Water | 800 ml |
| Solution VI | |
| Potassium Bromide | 101.5 g |
| Water | 800 ml |

A sulfur-containing silver halide solvent was previously added to Solution II, and an oxidizing agent or an acid was added to the system 5 minutes before the addition of Solutions V and VI. The kinds and amounts of additives are shown in Table 3.

The thus formed emulsion was rinsed in a conventional manner. The resulting emulsion was adjusted so as to have a pH value of 6.7 and a pAg value of 8.9, and then subjected to gold-sulfur sensitization using 3 mg of sodium thiosulfate, 1.8 mg of potassium chloroaurate and 30 mg of potassium thiocyanate.

To the thus obtained emulsion were added 4-hydroxy-6-methyl-1,3,3a,7-tetraazaindene as a stabilizer, sodium 2,4-dichloro-6-hydroxy-s-triazine as a hardener and sodium dodecylbenzenesulfonate as a coating assistant, and the resulting composition was coated on a cellulose acetate film support and dried to obtain Samples 50 to 59.

Each of the samples was exposed to light through an optical wedge, developed using D-72 Developer (Eastman Kodak) at 38° C. for 2 minutes and 45 seconds and then subjected to conventional stopping, fixing, rinsing and drying to obtain the results shown in Table 3.

In Table 3, the relative sensitivity represents a relative value of the reciprocal of the exposure dose required for providing a density of 0.2+fog, and the value obtained when Sample No. 50 had a fog value of 0.06 was taken as 100.

The mean grain size of each sample as determined by a microscope was as shown in Table 3.

As is apparent from Table 3, the emulsions wherein the sulfur-containing silver halide solvents were not inactivated showed comparatively high fog from the beginning of chemical ripening.

On the other hand, those emulsions wherein the grain growth effect had been eliminated during the grain formation showed comparatively low fog. With respect to sensitivity, although these emulsions had slightly reduced sensitivity as compared with the emulsions having the grain growth effect under the same ripening conditions, when they were subjected to chemical ripening under optimum conditions, high sensitivity could be attained in spite of the small grain size.

TABLE 3

| Emulsion No. | Silver Halide Solvent Kind | Silver Halide Solvent Amount* | Oxidizing Agent Kind | Oxidizing Agent Amount* | Mean Grain Size (μm) | Chemical Ripening (60° C., 40 min) Fog | Chemical Ripening (60° C., 40 min) Relative Sensitivity | Optimum Chemical Ripening (Fog = 0.06) Relative Sensitivity |
|---|---|---|---|---|---|---|---|---|
| 50 | (5) | 2.5 g | — | — | 0.93 | 0.06 | 100 | — |
| 51 | " | " | $H_2O_5$ (35%) | 1 cc | 0.80 | 0.05 | 95 | 110 |
| 52 | " | " | " | 2 cc | 0.78 | 0.03 | 92 | 115 |
| 53 | " | " | " | 5 cc | 0.78 | 0.03 | 83 | 120 |
| 54 | " | " | " | 10 cc | 0.78 | 0.02 | 60 | 120 |
| 55 | (15) | 4.8 g | — | — | 0.98 | 0.06 | 110 | — |
| 56 | " | " | $K_2S_2O_8$ | 4.1 g | 0.88 | 0.04 | 88 | 125 |
| 57 | " | " | " | 8.1 g | 0.85 | 0.03 | 70 | 120 |
| 58 | $NH_3$ (25%) | 45 cc | — | — | 1.20 | 0.23 | 115 | Fog was 0.07 before chemical ripening. |
| 59 | " | " | Glacial acetic acid | 45 cc | 0.80 | 0.10 | 98 | 85 |

*per 150 g of $AgNO_3$

EXAMPLE 6

To each of Emulsion Nos. 50, 53, 54, 55, 56 and 59 obtained in Example 5 were successively added sodium 5,5'-dichloro-9-ethyl-3,3'-di(3-sulfopropyl)oxacarbocyanine as a sensitizing dye; a magenta coupler emulsion comprising 1-(2,4,6-trichlorophenyl)-3-[3-(2,4-di-t-amylphenoxyacetamido)benzamido]-5-pyrazolone as a coupler and tricresyl phosphate as a coupler solvent; sodium 1-m-sulfophenyl-5-mercaptotetrazole as an antifoggant; 4-hydroxy-6-methyl-1,3,3a,7-tetraazaindene as a stabilizer; 1,3-bis-vinylsulfonylhydroxypropane as a hardener; and sodium p-dodecylbenzenesulfonate and sodium p-nonylphenoxypoly(ethyleneoxy)propane sulfonate as coating aids. The resulting compositions were coated on a cellulose acetate film support and dried to prepare Sample Nos. 60 to 65.

Each of the thus prepared samples was exposed to light through an optical wedge and subjected to the following color developlment processing. The results obtained are shown in Table 4.

Table 4 revealed surprising results in that the silver halide emulsions obtained by inactivating the sulfur-containing silver halide solvents with oxidizing agents exhibit high sensitivity and high contrast in color development processing in spite of the slightly smaller grain size of the silver halide crystals as compared with other emulsions.

The development processing in this example was performed as follows at a temperature of 38° C.:

| | |
|---|---|
| 1. Color Development | 1 min 30 sec |
| 2. Bleaching | 6 min 30 sec |
| 3. Rinsing | 3 min 15 sec |
| 4. Fixing | 6 min 30 sec |
| 5. Rinsing | 3 min 15 sec |
| 6. Stabilization | 3 min 15 sec |

The processing solutions used in the above-described processing had the following compositions:

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution | |
| Ammonium Bromide | 160.0 g |
| Aqueous Ammonia (28%) | 25.0 ml |
| Sodium (Ethylenediaminetetraacetato)-ferrate | 130.0 g |
| Glacial Acetic Acid | 14.0 ml |
| Water to make | 1 liter |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |
| Stabilizing Solution | |
| Formalin | 8.0 ml |
| Water to make | 1 liter |

been distributed throughout the individual grain comparatively uniformly.

On the other hand, the silver halide powders recovered from Emulsion Nos. 54, 57 and 59 showed two peaks, one of which corresponded to an iodine content of about 40 mol% of silver iodobromide formed in the first stage, and the other of which corresponded to nearly pure silver bromide fromed as an outer shell in the second stage.

These results clearly prove that the grain growth effect can be eliminated in the sulfur-containing silver halide solvent/oxidizing agent system similarly to the ammonia/acid system, and the iodine formed in the first stage can be prevented from penetrating into the outer shell to ensure the double layer structure of silver halide grains.

Further, it was confirmed by electron microscopic observation that generation of new silver bromide crystals (regeneration of nuclei) did not occur at the time of adding silver nitrate and potassium bromide in the second stage.

EXAMPLE 8

A potassium bromide aqueous solution and a silver nitrate aqueous solution were added dropwise to a gelatin aqueous solution containing a sulfur-containing silver halide solvent at 70° C. over a period of 120 minutes while vigorously stirring and maintaining the pAg value at 8.7 to obtain a monodispersed silver bromide emulsion.

Five minutes before the completion of the addition, an oxidizing agent was added to the system as indicated in Table 5.

The emulsion was washed with water in a conventional manner and adjusted so as to have a pH value of 6.8 and a pAg value of 8.9.

Each of the resulting emulsions was subjected to sulfur sensitization with 2-(3-ethylthioureido)-4-methyl-

TABLE 4

| Emulsion | Silver Halide Solvent | | Oxidizing Agent | | Chemical Ripening (60° C., 40 min) | | Optimum Chemical Ripening (Fog = 0.08) | |
|---|---|---|---|---|---|---|---|---|
| No. | Kind | Amount* | Kind | Amount* | Fog | Relative Sensitivity | Relative Sensitivity | Gamma |
| 60 | (5) | 2.5 g | — | — | 0.08 | 100 | — | 1.0 |
| 61 | " | " | $H_2O_2$ (35%) | 5 cc | 0.04 | 85 | 125 | 1.4 |
| 62 | " | " | " | 10 cc | 0.03 | 62 | 123 | 1.6 |
| 63 | (15) | 4.8 g | — | — | 0.08 | 108 | — | 0.9 |
| 64 | " | " | $K_2S_2O_8$ | 4.1 g | 0.03 | 72 | 122 | 1.5 |
| 65 | $NH_3$ (25%) | 45 cc | Acetic acid | 45 cc | 0.15 | 100 | 90 | 1.0 |

*per 150 g of $AgNO_3$

EXAMPLE 7

This example aims to demonstrate that silver halide grains having a double layer structure can be formed by using the sulfur-containing silver halide solvent according to the present invention.

Silver halide grains were recovered from each of the emulsions used in Samples Nos. 50, 54, 55, 57, 58 and 59 prepared in Example 5 by enzymatically decomposing the gelatin contained therein, and subjected to X-ray diffraction with NaCl as an internal standard.

It can be seen from the results obtained that the silver halide powders recovered from Emulsion Nos. 50, 55 and 58 wherein the sulfur-containing silver halide solvents were not inactivated during the formation of grains showed a single peak corresponding to an iodine content of about 6.5 mol%, indicating that iodine had thiazole in such a manner that the sensitized emulsions had the same sensitivity. The emulsions were then divided into two, to one of which was added 5,5'-dichloro-9-ethyl-3,3'-di(3-sulfopropyl)oxacarbocyanine sodium salt as a sensitizing dye. To each of the resulting samples were added the same stabilizer, hardener and coating aid as used in Example 5, and the composition was coated on a cellulose acetate film support followed by drying.

Samples to which the sensitizing dye had not been added were exposed to white light, and samples to which the sensitizing dye had been added were exposed to light through a yellow filter and an optical wedge. Each of the thus exposed samples was developed with D-19 Developer (Eastman Kodak) at 20° C. for 4 minutes and then stopped, fixed, rinsed and dried in a conventional manner. The results obtained are shown in Table 5.

As is apparent from Table 5, the samples in which the oxidizing agent of the present invention had been added to inactivate the sulfur-containing silver halide solvent adsorbed onto silver halide grains showed markedly improved spectral sensitivity due to the sensitizing dye.

From the above-described results as well as from the results of reflective spectrophotometry of the film surface indicating increased adsorption of the sensitizing dye, it can be seen that adsorption of the dye onto silver halide grains increases according to the method of the present invention. In other words, the method of the present invention can prevent the sulfur-containing silver halide solvents having strong adsorption onto silver halide grains from interfering with adsorption of sensitizing dyes onto the grains.

The same results as described above could also be obtained in the cases of using other cyanine dyes (e.g., sodium 5,5',6,6'-tetrachloro-1,1'-diethyl-3,3'-(3-sulfopropyl)imidacarbocyanine or sodium 5,5'-dichloro-9-ethyl-3,3'-di(3-sulfopropyl)thiacarbocyanine) or merocyanine dyes (e.g., 3-carboxymethyl-5-[2-(3-ethyl-2(3H)thiazolinidene-ethylidene]rhodanine, etc.).

TABLE 5

| Sample No. | Sulfur-Containing Silver Halide Solvent Kind | Sulfur-Containing Silver Halide Solvent Amount per Mol of AgX (mg) | Oxidizing Agent Kind | Oxidizing Agent Amount per Mol of AgX | Relative Sensitivity without Dye | Relative Sensitivity with Dye |
|---|---|---|---|---|---|---|
| 70 | (37) | 95 | — | — | 100 | 100 |
| 71 | " | " | $H_2O_2$ (35%) | 2.5 cc | 102 | 170 |
| 72 | (16) | 120 | — | — | 100 | 100 |
| 73 | " | " | $H_2O_2$ (35%) | 3.5 cc | 104 | 150 |
| 74 | (45) | 50 | — | — | 100 | 100 |
| 75 | " | " | $K_2S_2O_8$ | 675 mg | 102 | 155 |

EXAMPLE 9

This example demonstrates that changes in photographic properties due to dissolution of a silver halide emulsion for a long period of time before coating can be reduced because the effect of the sulfur-containing silver halide solvent is prevented from extending to the stages of chemical ripening or dissolution before coating by the method of the present invention.

An aqueous solution containing potassium bromide and sodium chloride and an aqueous solution of silver nitrate were simultaneously added dropwise to a gelatin aqueous solution at 55° C. over 35 minutes while vigorously stirring to prepare a silver chlorobromide emulsion (bromine content: 60 mol%). The sulfur-containing silver halide solvent was added to the gelatin aqueous solution in advance, and the oxidizing agent was added to the system one minute before completion of the addition of silver nitrate.

Thereafter, the emulsion was washed with water according to a conventional flocculation process, wherein sodium benzenesulfinate had been added to the first rinsing solution to inactivate any remaining oxidizing agent and the emulsion was further washed with water twice.

The emulsion was adjusted to a pH of 6.3 and a pAg of 7.8 and then subjected to sulfur sensitization using 3.5 mg of sodium thiosulfate per mol of silver halide at 50° C. for 30 minutes. The chemical ripening was stopped by adding 250 mg of 4-hydroxy-6-methyl-(1,3,3a,7)tetraazaindene.

To the resulting emulsion were added α-pivaloyl-α-(2,4-dioxo-5,5'-dimethyloxazolidin-3-yl)-2-chloro-5-[α-2,4-(di-t-amylphenoxy)butaneamido]acetanilide as a yellow coupler; sodium dodecylbenzenesulfonate as a coating aid; and sodium 2,4-dichloro-6-hydroxy-s-triazine as a hardener. The resulting complete emulsion was coated on a paper support immediately after dissolution or after 3 hours at 40° C. for dissolution.

Each of the above obtained samples was exposed to light through an optical wedge and subjected to the following development processing, to thereby obtain the results shown in Table 6.

In Table 6, relative sensitivity represents the relative value of the reciprocal of the exposure dose required to give a density of fog+0.5, with that value for each sample prepared by coating the emulsion immediately after dissolution being taken as 100.

Development Processing

| Step | Time | Temperature |
|---|---|---|
| Color Development | 2 min 30 sec | 33° C. |
| Bleach-Fixing | 1 min 30 sec | " |
| Rinsing | 2 min 00 sec | " |
| Drying | | |

| Color Developing Solution | |
|---|---|
| Benzyl Alcohol | 15 ml |
| Sodium Sulfite | 5 g |
| Potassium Bromide | 0.5 g |
| Hydroxylamine Sulfate | 2.0 g |
| Sodium Carbonate | 30.0 g |
| Sodium Nitrilotriacetate | 2.0 g |
| 4-Amino-3-methyl-N—(β-methanesulfonamido)ethylaniline | 5.0 g |
| Water to make | 1,000 ml (pH 10.1) |

| Bleach-Fixing Solution | |
|---|---|
| Ammonium Thiosulfate | 105 g |
| Sodium Sulfite | 2 g |
| Sodium-Iron Ethylenediaminetetraacetate | 40 g |
| Sodium Carbonate ($H_2O$) | 5 g |
| Water to make | 1,000 ml (pH 7.0) |

As is apparent from Table 6, changes in photographic properties caused by the passage of time needed for dissolution before coating can be markedly reduced by previous inactivation of the sulfur-containing silver halide solvent per the present invention.

TABLE 6

| Sample No. | Sulfur-Containing Silver Halide Solvent Kind | Amount (mg/mol AgX) | Oxidizing Agent Kind | Amount (cc) | Coating Immediately after Dissolution Fog | Relative Sensitivity | Coating after Dissolution (40° C. × 3 hrs) Fog | Relative Sensitivity |
|---|---|---|---|---|---|---|---|---|
| 90 | (23) | 120 | — | — | 0.03 | 100 | 0.05 | 108 |
| 91 | " | " | $H_2O_2$ (35%) | 2.5 | 0.03 | 100 | 0.03 | 100 |
| 92 | (5) | 250 | — | — | 0.03 | 100 | 0.04 | 105 |
| 93 | " | " | $H_2O_2$ (35%) | 2.0 | 0.03 | 100 | 0.03 | 100 |

EXAMPLE 10

The same procedures as described in Example 1 were repeated except that the sulfur-containing silver halide solvents used in Example 1 were replaced by the mesoionic compounds as indicated in Table 7. The results obtained are also shown in Table 7.

As is apparent from Table 7, silver halide crystals having larger sizes can be produced in the presence of the sulfur-containing silver halide solvents, but the addition of the oxidizing agents reduces or eliminates the grain growth effect of the sulfur-containing silver halide solvents. This is a surprising result that was never anticipated.

On the other hand, when ammonia is used as a silver halide solvent, the grain growth effect thereof naturally disappears upon neutralization with an acid, but cannot be eliminated by the addition of an oxidizing agent.

Further, when only the oxidizing agent was added to the system, the resulting silver halide crystals had a mean grain size of 0.18 μm, that is, the same as that of Emulsion No. 101.

TABLE 7

| Emulsion No. | Silver Halide Solvent Kind | Amount** (mmol) | Oxidizing Agent Kind | Amount** | Mean Grain Size (μm) |
|---|---|---|---|---|---|
| 101 | — | — | — | — | 0.18 |
| 102 | (49) | 0.3 | — | — | 0.52 |
| 103 | " | " | $H_2O_2$ (35%) | 3 cc | 0.18 |
| 104 | (54) | 0.5 | — | — | 0.65 |
| 105 | " | " | $H_2O_2$ (35%) | 3 cc | 0.18 |
| 106 | " | " | $K_2S_2O_8$ | 450 mg | 0.18 |
| 107 | " | " | Chloramine B | 450 mg | 0.20 |
| 108 | " | " | $O_3$ gas blown for 10 minutes | | 0.18 |
| 109 | (56) | 0.5 | — | — | 0.55 |
| 110 | " | " | $H_2O_2$ (35%) | 3 cc | 0.18 |
| 111 | (57) | 0.5 | — | — | 0.35 |
| 112 | " | " | $H_2O_2$ (35%) | 1.5 cc | 0.18 |
| 113 | (65) | 0.5 | — | — | 0.38 |
| 114 | " | " | $NaBO_2.H_2O_2.3H_2O$ | 500 mg | 0.20 |
| 115 | " | " | Peracetic acid (50%) | 3.5 cc | 0.18 |
| 116 | $NH_3$ | 12 | — | — | 0.65 |
| 117 | " | " | $H_2O_2$ (35%)* | 5 cc | 0.64 |
| 118 | " | " | Neutralization with glacial acetic acid | | 0.18 |

Note:
*Slight reduction in pH level by the addition of $H_2O_2$ was corrected by sodium hydroxide.
**per 0.02 mol of $AgNO_3$

EXAMPLE 11

The same procedures as described in Example 2 were repeated except for using Emulsion Nos. 101, 102, 104 and 111 obtained in Example 10 in place of Emulsion Nos. 1, 2, 8, 22 and 36. The results obtained are shown in Table 8.

It can be seen from Table 8 that the compounds of formula (IV) accelerate the physical ripening of silver halide grains to produce grains of larger size, but such a grain growth effect of compounds (IV) disappears by the addition of the oxidizing agents according to the present invention.

TABLE 8

| Emulsion No. | Oxidizing Agent Kind | Amount** | Mean Grain Size before Heating* (μm) | Mean Grain Size after Heating (μm) |
|---|---|---|---|---|
| 101 | — | — | 0.18 | 0.21 |
| " | $H_2O_2$ (35%) | 1.5 ml | " | " |
| 102 | — | — | 0.52 | 0.85 |
| " | $H_2O_2$ (35%) | 1.4 ml | " | 0.55 |
| 104 | — | — | 0.65 | 0.92 |
| " | $K_2S_2O_8$ | 120 mg | " | 0.68 |
| 111 | — | — | 0.35 | 0.48 |
| " | Chloramine T | 250 mg | " | 0.40 |

Note:
*The mean grain size before heating was taken from the results of Table 7.
**per 0.01 mol $AgNO_3$

EXAMPLE 12

The same procedures as described in Example 5 were repeated except that the compounds of formula (IV) as indicated in Table 9 were used as the sulfur-containing silver halide solvents; gold-sulfur sensitization was conducted using 2.2 mg of sodium thiosulfate, 2.2 mg of potassium chloroaurate and 30 mg of potassium thiocyanate; and the resulting samples were designated Samples 120 to 125.

The results obtained are shown in Table 9. In Table 9, the relative sensitivity has the same meaning as described in Example 5, and the value of Sample 120 (fog=0.06) was taken as 100.

As is apparent from Table 9, the emulsions in which the sulfur-containing silver halide solvents were not inactivated showed comparatively high fog from the beginning of chemical ripening.

On the other hand, those emulsions wherein the grain growth effect of the sulfur-containing silver halide solvents had been eliminated during grain formation showed comparatively low fog. With respect to sensitivity, although these emulsions had slightly reduced sensitivity as compared with the emulsions retaining the grain growth effect under the same ripening conditions, when they were subjected to chemical ripening under optimum conditions, high sensitivity could be attained in spite of the small grain size.

TABLE 9

| Emulsion No. | Silver Halide Solvent Kind | Silver Halide Solvent Amount* (g) | Oxidizing Agent Kind | Oxidizing Agent Amount* | Mean Grain Size (μm) | Chemical Ripening (60° C., 40 min) Fog | Chemical Ripening (60° C., 40 min) Relative Sensitivity | Optimum Chemical Ripening (Fog = 0.06) Relative Sensitivity |
|---|---|---|---|---|---|---|---|---|
| 120 | (54) | 0.48 | — | — | 0.85 | 0.06 | 100 | — |
| 121 | " | " | $H_2O_2$ (35%) | 1 cc | 0.80 | 0.04 | 92 | 112 |
| 122 | " | " | " | 5 cc | 0.78 | 0.03 | 81 | 115 |
| 123 | (57) | 0.42 | — | — | 0.75 | 0.05 | 85 | 90 |
| 124 | " | " | $K_2S_2O_8$ | 3 g | 0.72 | 0.04 | 77 | 109 |
| 125 | " | " | $H_2O_2$ (35%) | 5 cc | 0.72 | 0.03 | 75 | 110 |

*per 150 g of $AgNO_3$

EXAMPLE 13

To each of Emulsion Nos. 120, 122, 123 and 124 which were obtained in Example 12 and which had been subjected to optimum chemical sensitization so as to have a fog of 0.06 was added sodium 5,5'-dichloro-9-ethyl-3,3'-di(3-sulfopropyl)oxacarbocyanine as a sensitizing dye and there were further added the same additives as used in Example 5 in the same amounts as in Example 5. The resulting composition was coated on a cellulose acetate film support and dried to obtain Samples 131 to 134.

Each of the samples was exposed to light under a yellow filter through an optical wedge and subjected to the same development processing as used in Example 5 to obtain the results shown in Table 10.

In Table 10, the relative sensitivity represents the relative value of the reciprocal of the exposure dose required for providing a density of 0.2+fog, and the value obtained for Sample 131 was taken as 100.

TABLE 10

| Emulsion No. | Silver Halide Solvent Kind | Silver Halide Solvent Amount* (g) | Oxidizing Agent Kind | Oxidizing Agent Amount* | Relative Sensitivity without Dye (from Table 9) | Relative Sensitivity with Dye under Yellow Filter |
|---|---|---|---|---|---|---|
| 131 | (54) | 0.48 | — | — | 100 | 100 |
| 132 | " | " | $H_2O_2$ (35%) | 5 cc | 115 | 315 |
| 133 | (57) | 0.42 | — | — | 85 | 77 |
| 134 | " | " | $K_2S_2O_8$ | 3 g | 105 | 255 |

*per 150 g of $AgNO_3$

As is apparent from Table 10, the samples in which the oxidizing agent of the present invention had been added to inactivate the sulfur-containing silver halide solvent adsorbed onto silver halide grains showed markedly improved spectral sensitivity due to the sensitizing dye.

From the above-described results as well as the results of reflective spectrophotometry of the film surface indicating increased adsorption of the sensitizing dye, it can be seen that adsorption of the dye onto silver halide grains increased per the present invention. In other words, the method of the present invention can prevent the sulfur-containing silver halide solvents having a strong adsorption onto silver halide grains from interfering with adsorption of sensitizing dyes onto the grains.

The same results as described above could also be obtained in the cases of using other cyanine dyes (e.g., sodium 5,5',6,6'-tetrachloro-1,1'-diethyl-3,3'-(3-sulfopropyl)imidacarbocyanine or sodium 5,5'-dichloro-9-ethyl-3,3'-di(3-sulfopropyl)thiacarbocyanine) or merocyanine dyes (e.g., 3-carboxymethyl-5-[2-(3-ethyl-2(3H)thiazolinidine-ethylidene]rhodanine, etc.).

While the invention has been described in detail and with reference to specific embodiments thereof, it will be apparent to one skilled in the art that various changes and modifications can be made therein without departing from the spirit and scope thereof.

What is claimed is:

1. A process for preparing a silver halide emulsion wherein the process is carried out in the presence of a sulfur-containing silver halide solvent which accelerates growth of silver halide grains and an oxidizing agent capable of reducing or eliminating the grain growth effect of said sulfur-containing silver halide solvent.

2. A process as claimed in claim 1, wherein said sulfur-containing silver halide solvent is selected from the group consisting of thiocyanates, organic thioether compounds, thione compounds, mercapto compounds and meso-ionic compounds.

3. A process as claimed in claim 2, wherein the organic thioether compounds are represented by the formula (I):

$$R^1\text{-}(S\text{—}R^3)_m S\text{—}R^2 \qquad \text{(I)}$$

wherein m represents 0 or an integer of from 1 to 4; $R^1$ and $R^2$, which may be the same or different, each represents a lower alkyl group having from 1 to 5 carbon atoms or a substituted alkyl group having from 1 to 30 total carbon atoms substituted by —OH, —COOM, $—SO_3M$, $—NHR^4$, $—NR^4R^4$, wherein the two $R^4$ may be the same or different, $—OR^4$, $—CONHR^4$, $—COOR^4$ or a heterocyclic ring; M represents a hydrogen atom or a cation; $R^4$ represents a hydrogen atom, a lower alkyl group or a substituted alkyl group substituted with the above-described substituent or substituents which may be the same or different; or $R^1$ and $R^2$ form a cyclic thioether when connected to each other; and $R^3$, which may be the same or different when m is 2 or more, represents an alkylene group or an alkylene group substituted with a substituent as described for $R^1$ and $R^2$; and $R^3$ may contain in its alkylene chain one or more of —O—, —CONH— and $—SO_2NH—$.

4. A process as claimed in claim 3, wherein the substituted or unsubstituted alkylene group as represented by $R^3$ contains from 1 to 12 carbon atoms.

5. A process as claimed in claim 2, wherein the thione compounds are represented by formula (II):

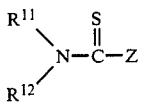

(II)

wherein Z represents

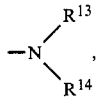

$—OR^{15}$ or $—SR^{16}$; $R^{11}$, $R^{12}$, $R^{13}$, $R^{14}$, $R^{15}$ and $R^{16}$, which may be the same or different, each represents an alkyl group, a substituted alkyl group, an alkenyl group, a substituted alkenyl group, an aralkyl group, a substituted aralkyl group, an aryl group, a substituted aryl group, a heterocyclic group or a substituted heterocyclic group; or $R^{11}$ and $R^{12}$, $R^{13}$ and $R^{14}$, or $R^{11}$ and $R^{13}$, $R^{11}$ and $R^{15}$, and $R^{11}$ and $R^{16}$ may form a 5- or 6-membered substituted or unsubstituted heterocyclic ring when connected to each other, respectively.

6. A process as claimed in claim 5, wherein the alkyl, substituted alkyl, alkenyl, substituted alkenyl, aralkyl, substituted aralkyl, aryl, substituted aryl, heterocylic or substituted heterocyclic group as represented by $R^{11}$, $R^{12}$, $R^{13}$, $R^{14}$, $R^{15}$ or $R^{16}$ contains not more than 30 total carbon atoms.

7. A process as claimed in claim 2, wherein the mercapto compounds are represented by formula (III):

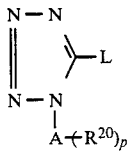

(III)

wherein A represents an alkylene group; $R^{20}$ represents $—NH_2$, $—NHR^{21}$,

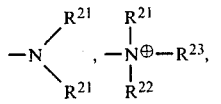

$—CONHR^{24}$, $—OR^{24}$, —COOM, $—COOR^{21}$, $—SO_2NHR^{24}$, $—NHCOR^{21}$ or $—SO_3M$; p represents 1 or 2; L represents $—S^{\ominus}$ when $R^{20}$ is

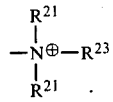

or L represents —SM when $R^{20}$ is the group other than

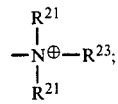

$R^{21}$, $R^{22}$ and $R^{23}$ each represents an alkyl group; $R^{24}$ represents a hydrogen atom or an alkyl group; and M represents a hydrogen atom or a cation.

8. A process as claimed in claim 7, wherein $R^{20}$ contains not more than 30 total carbon atoms.

9. A process as claimed in claim 7, wherein M represents a hydrogen atom, an alkali metal ion or an ammonium ion.

10. A process as claimed in claim 2, wherein the meso-ionic compounds are represented by formula (IV):

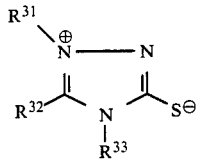

(IV)

wherein $R^{31}$ and $R^{32}$ each represents a substituted or unsubstituted alkyl group, a substituted or unsubstituted alkenyl group, a substituted or unsubstituted cycloalkyl group, a substituted or unsubstituted aryl group or a substituted or unsubstituted heterocyclic group; $R^{33}$ represents a substituted or unsubstituted alkyl group, a substituted or unsubstituted alkenyl group, a substituted or unsubstituted cycloalkyl group, a substituted or unsubstituted aryl group, a substituted or unsubstituted aralkyl group, a substituted or unsubstituted heterocyclic group or $—NR^{34}R^{35}$; $R^{34}$ and $R^{35}$ each represents a hydrogen atom, an alkyl group or an aryl group; or $R^{31}$ and $R^{32}$ or $R^{33}$ form a 5- or 6-membered ring when taken together, respectively.

11. A process as claimed in claim 10, wherein $R^{31}$, $R^{32}$ and $R^{33}$ each contains not more than 16 carbon atoms.

12. A process as claimed in claim 11, wherein $R^{33}$ contains not more than 10 carbon atoms.

13. A process as claimed in claim 10, wherein $R^{31}$, $R^{32}$ or $R^{33}$ represents a lower alkyl group having from 1 to 6 carbon atoms, or $R^{31}$ and $R^{32}$ form a 5- or 6-membered ring.

14. A process as claimed in claim 10, wherein $R^{31}$, $R^{32}$ or $R^{33}$ represents a lower alkyl group having from 1 to 6 carbon atoms.

15. A process as claimed in claim 1, wherein said oxidizing agent is an organic or inorganic compound which is capable of oxidizing said sulfur-containing silver halide solvent when said oxidizing agent is used in an amount of 3,000 or more molar times the amount of said sulfur-containing silver halide solvent at 50° C.

16. A process as claimed in claim 1, wherein the oxidizing agent is an inorganic oxidizing agent, an organic oxidizing agent, an oxidizing gas or an oxidizing compound capable of releasing halogen.

17. A process as claimed in claim 16, wherein the oxidizing agent is an inorganic oxidizing agent or an oxidizing gas.

18. A process as claimed in claim 17, wherein the oxidizing agent is an inorganic oxidizing agent.

19. A process as claimed in claim 18, wherein the inorganic oxidizing agent is hydrogen peroxide or an adduct thereof.

20. A process as claimed in claim 1, wherein the oxidizing agent is used in the presence of a catalyst.

21. A process as claimed in claim 20, wherein said catalyst is an oxide or salt of a heavy metal or a noble metal.

22. A process as claimed in claim 20, wherein the catalyst is sodium tungstate, tungsten trioxide, pervanadic acid, vanadium pentoxide, osmium tetroxide, a molybdenum salt, a manganese salt, an iron salt, a copper salt, selenium dioxide or catalase.

23. A process as claimed in claim 20, wherein the catalyst is used in an amount of from 10 mg to 1 g per mole of silver.

24. A process as claimed in claim 1, wherein the sulfur-containing silver halide solvent is used in an amount of from $10^{-5}$ to $5\times10^{-1}$ mole per mole of silver halide.

25. A process as claimed in claim 24, wherein the sulfur-containing silver halide solvent is used in an amount of from $3\times10^{-4}$ to $10^{-1}$ mol per mol of silver halide.

26. A process as claimed in claim 1, wherein the oxidizing agent is used in an amount 1/100 to 3,000 molar times the sulfur-containing silver halide solvent.

27. A process as claimed in claim 26, wherein the oxidizing agent is used in an amount 1/100 to 500 molar times the sulfur-containing silver halide solvent.

28. A process as claimed in claim 27, wherein the oxidizing agent is used in an amount 1/50 to 100 molar times the sulfur-containing silver halide solvent.

29. A process as claimed in claim 1, wherein the oxidizing agent is added to a system previously containing the sulfur-containing silver halide solvent during or after the growth of silver halide grains.

30. A process as claimed in claim 29, wherein said oxidizing agent is added at a stage of from immediately after the growth of silver halide grains to before the start of chemical ripening.

31. A process as claimed in claim 1, wherein the sulfur-containing silver halide solvent is added to a system during or after the formation or growth of silver halide grains and then the oxidizing agent is added thereto.

32. A process as claimed in claim 31, wherein said oxidizing agent is added at a stage of from after adding said sulfur-containing silver halide solvent to before the start of chemical ripening.

33. A process as claimed in claim 1, wherein the sulfur-containing silver halide solvent is added to a system previously containing the sulfur-containing silver halide solvent during or after the formation or growth of silver halide grains, and then the oxidizing agent is added thereto followed by or simultaneously with adding silver nitrate, a halide or a combination thereof to form multistructure silver halide grains.

34. A process as claimed in claim 1, wherein said oxidizing agent is used in the presence of a nitrate salt or a sulfate salt.

35. A process as claimed in claim 34, wherein the salt is potassium nitrate, ammonium nitrate, potassium sulfate, sodium sulfate, potassium acetate, sodium acetate or potassium citrate.

36. A process as claimed in claim 34 or 35, wherein the salt is used in an amount of from 1 to 20 g per mol of silver.

37. A process as claimed in claim 1, wherein excess of oxidizing agent is inactivated by a reducing agent.

38. A process as claimed in claim 37, wherein the reducing agent is a sulfite, a sulfinic acid or a reducing sugar.

39. A process as claimed in claim 37 or 38, wherein the reducing agent is used after the addition of the oxidizing agent and before the start of chemical ripening.

40. A process as claimed in claim 37 or 38, wherein the reducing agent is used in an amount of from 1 to 50 mols per mol of the oxidizing agent.

* * * * *